US010814651B2

(12) United States Patent
Otani et al.

(10) Patent No.: US 10,814,651 B2
(45) Date of Patent: Oct. 27, 2020

(54) INK JET RECORDING METHOD

(71) Applicant: CANON KABUSHIKI KAISHA, Tokyo (JP)

(72) Inventors: Takumi Otani, Yokohama (JP); Ryohei Goto, Fujisawa (JP); Fumihiro Goto, Kawasaki (JP); Yohei Iwasaki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/585,315

(22) Filed: Sep. 27, 2019

(65) Prior Publication Data

US 2020/0114660 A1 Apr. 16, 2020

(30) Foreign Application Priority Data

Oct. 10, 2018 (JP) ..... 2018-191929

(51) Int. Cl.
*B41M 7/00* (2006.01)
*B41J 11/00* (2006.01)

(52) U.S. Cl.
CPC ..... *B41J 11/002* (2013.01)

(58) Field of Classification Search
CPC ..... B41J 11/002; B41J 2/0057; B41M 7/009
See application file for complete search history.

(56) References Cited

U.S. PATENT DOCUMENTS

| | | | |
|---|---|---|---|
| 9,527,314 | B2 | 12/2016 | Moriguchi et al. |
| 9,707,751 | B2 | 7/2017 | Nishitani et al. |
| 10,046,556 | B2 | 8/2018 | Soma et al. |
| 10,421,270 | B2 | 9/2019 | Kuwabara et al. |
| 10,569,531 | B2 * | 2/2020 | Ohnishi ..... B41M 7/0018 |
| 2018/0304615 | A1 | 10/2018 | Soma et al. |
| 2019/0366706 | A1 | 12/2019 | Kuwabara et al. |

FOREIGN PATENT DOCUMENTS

JP 2016-203626 A 12/2016

* cited by examiner

*Primary Examiner* — Huan H Tran
(74) *Attorney, Agent, or Firm* — Venable LLP

(57) ABSTRACT

An ink jet recording method of the present invention includes a fixing step under the following condition (1) or (2) when on a recording medium, an image including an image part formed of colored ink and an image part formed of transparent ink is fixed:

$$T1>\mathrm{MFT1}>\mathrm{MFT2} \text{ and } \mathrm{MFT1}>T2>\mathrm{MFT2} \quad (1)$$

$$T1>\mathrm{MFT2}>\mathrm{MFT1} \text{ and } \mathrm{MFT2}>T2>\mathrm{MFT1}. \quad (2)$$

MFT1: Minimum film forming temperature of colored ink
MFT2: Minimum film forming temperature of transparent ink
T1: Temperature of fixing member when image is heated and pressed
T2: Temperature of fixing member when image is separated from fixing member.

18 Claims, 11 Drawing Sheets

INK JET RECORDING METHOD

BACKGROUND OF THE INVENTION

Field of the Invention

The present invention relates to an ink jet recording method.

Description of the Related Art

In one of the known image forming methods, an image that is formed by applying ink containing resin particles on a recording medium by an ink jet method is heated and pressed so as to be fixed; thus, the ink is made into a film. According to this image forming method, by making the ink that forms the image into the film, the rubfastness can be improved and by increasing the flatness of the surface of the ink film, the image can have high gloss.

Japanese Patent Application Laid-Open No. 2016-203626 has disclosed a method of generating a difference in gloss between an image part that has been made into a film obtained from an aggregation layer of a first liquid composition containing a coloring material and an image part that has been made into a film obtained from an aggregation layer of a second liquid composition not containing a coloring material. Japanese Patent Application Laid-Open No. 2016-203626 has employed a first fixing step of heating and pressing an image, which can be made into a film formed on a recording medium, with a first fixing member and a second fixing step of, after heating and pressing with a second fixing member, cooling the image, separating the second fixing member, and fixing the image made into the film on the recording medium. The image that can be made into the film to be fixed includes the image part including the aggregation layer of the first liquid composition containing the coloring material and the image part including the aggregation layer of the second liquid composition not containing the coloring material. In Japanese Patent Application Laid-Open No. 2016-203626, the intended gloss difference is generated through the fixing step performed under the following conditions (1-1) and (1-2):

$$\mathrm{MFT1} > \mathrm{MFT2} \tag{1-1}$$

$$T1 > \mathrm{MFT1} \geq T2 > \mathrm{MFT2} \geq T3. \tag{1-2}$$

MFT1: Minimum film forming temperature of aggregation layer of first liquid composition containing coloring material MFT2: Minimum film forming temperature of aggregation layer of second liquid composition not containing coloring material T1: Temperature of first and second liquid composition aggregation layers at heating and pressing in first fixing step T2: Temperature images resulting from first and second liquid composition aggregation layers at heating and pressing in second fixing step T3: Temperature at separation in second fixing step

SUMMARY OF THE INVENTION

It is an object of the present invention to provide an ink jet recording method that can form an image in which the gloss difference is large in some areas, and the unevenness in gloss is small.

An ink jet recording method according to one aspect of the present invention includes forming an image on a recording medium using colored ink containing a coloring material and first resin, and transparent ink containing second resin; and fixing the image on the recording medium, the fixing including:

heating and pressing the image with a fixing member in contact with the image formed on the recording medium;

cooling the image that has been heated and pressed; and separating the image that has been cooled from the fixing member, thereby fixing the image on the recording medium, wherein a temperature (T1) of a surface of the fixing member when the image is heated and pressed is higher than a minimum film forming temperature (MFT1) of the colored ink and a minimum film forming temperature (MFT2) of the transparent ink, and a temperature (T2) of the surface of the fixing member when the image is separated from the fixing member is between the minimum film forming temperature (MFT1) of the colored ink and the minimum film forming temperature (MFT2) of the transparent ink.

Further features of the present invention will become apparent from the following description of exemplary embodiments with reference to the attached drawings.

DESCRIPTION OF THE EMBODIMENTS

Figure 1A:
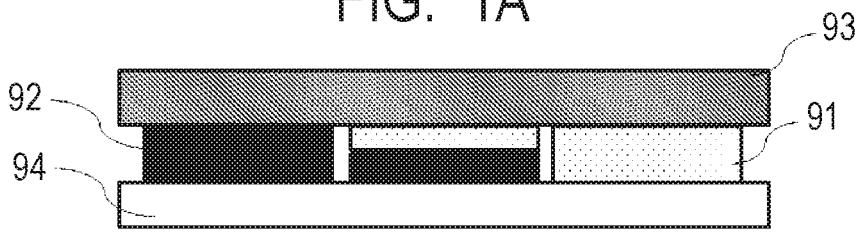
FIG. 1A and FIG. 1B are schematic views illustrating a gloss difference generating method in the present invention.

It has been required to increase the gloss difference between high gloss and low gloss as compared to an image formed by the ink jet recording method according to Japanese Patent Application Laid-Open No. 2016-203626.

The present inventors have conducted earnest researches for forming an image in which the gloss difference is large in some areas and the unevenness in gloss is small, and have completed the present invention.

An ink jet recording method according to the present invention includes the following steps:

(A) an image forming step of forming an image on a recording medium using colored ink containing a coloring material and first resin, and transparent ink containing second resin; and (B) a fixing step of fixing the image, which has been formed on the recording medium, on the recording medium.

In the fixing step, with a fixing member in contact with the image formed on the recording medium, (i) the image is heated and pressed, (ii) the heated and pressed image is cooled, and (iii) the cooled image is separated from the fixing member. Thus, the image can be fixed on the recording medium.

In the present invention, in this fixing step, the temperature (T1) of the surface of the fixing member when the image is heated and pressed, the minimum film forming temperature (MFT1) of the colored ink when the image is formed, and the minimum film forming temperature (MFT2) of the transparent ink satisfy the following relation:

$$T1>\mathrm{MFT1}$$

$$T1>\mathrm{MFT2}.$$

That is to say, the temperatures are controlled so that the temperature (T1) of the surface of the fixing member when the image is heated and pressed becomes higher than the minimum film forming temperature (MFT1) of the colored ink and the minimum film forming temperature (MFT2) of the transparent ink.

In this fixing step, the temperature (T2) of the surface of the fixing member when the image is separated from the fixing member is set between the minimum film forming temperature (MFT1) of the colored ink and the minimum film forming temperature (MFT2) of the transparent ink. That is to say, the temperature (T2) of the surface of the fixing member when the image is separated from the fixing member, the minimum film forming temperature (MFT1) of the colored ink, and the minimum film forming temperature (MFT2) of the transparent ink satisfy the following relation: MFT1<T2<MFT2 or MFT2<T2<MFT1.

Therefore, the fixing member is separated from the image at a timing when the temperature of the surface of the fixing member has decreased to become the temperature between MFT1 and MFT2.

The part formed of the colored ink and the part formed of the transparent ink in the image formed on the recording medium can be made into the film, and before the fixing step, each have the minimum film forming temperature (MFT: Minimum Film Forming Temperature). The image part before the fixing, which is the part formed of the colored ink and before the fixing, includes the coloring material and the first resin, and by being heated at MFT1 or more, is made into the film. The image part before fixing, which is formed of the transparent ink and before the fixing, includes the second resin, and by being heated at MFT2 or more, is made into the film.

The mode of the colored ink at the image part before the fixing process (before fixing step) may be either in the mode of the colored ink with the increased viscosity containing the coloring material and the resin, or in the mode as the aggregate containing the coloring material and the resin.

The mode of the transparent ink at the image part before the fixing process (before fixing step) may be either the mode of the transparent ink with the increased viscosity not containing the coloring material but containing the resin, or the mode as the aggregate not containing the coloring material but containing the resin.

The temperatures T1 and T2 of the surface of the fixing member correspond to the temperature of the surface of the fixing member on the side in contact with the image to be fixed on the recording medium. The image to be fixed on the recording medium by the fixing member is so thin that it is unnecessary to consider the temperature gradient in the image. Therefore, the temperature (T1) of the surface of the fixing member when the image is heated and pressed can be the temperature of the image when the image is heated and pressed. From the similar reason, the temperature (T2) of the surface of the fixing member when the image is separated from the fixing member can be the temperature of the image when the image is separated.

The fixing step described as (B) above is also referred to as a cool separating and fixing step. In addition, T1 is also referred to as pressing temperature, and T2 is also referred to as separating temperature.

First, a method of generating the gloss difference in the image parts in the present invention is briefly described.

Figure 1B:
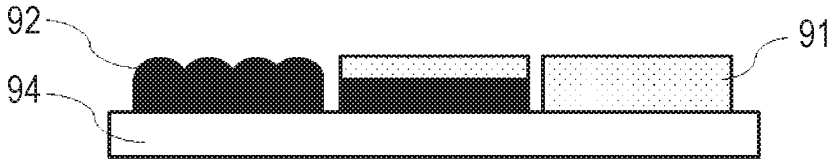

FIG. 1A and FIG. 1B are schematic sectional views of an image formed on a recording medium 94 that is output in accordance with the present invention. FIG. 1A illustrates a state in which a fixing member 93 and an image part are in close contact with each other, and FIG. 1B illustrates a state after the fixing member 93 is separated from the image part. In this example, using colored ink with low minimum film forming temperature (MFT1) and transparent ink with high minimum film forming temperature (MFT2), an image including a colored ink layer 92 and a transparent ink layer 91 is formed on a recording medium. In the cool separating and fixing step, the pressing temperature (T1) is higher than the minimum film forming temperature of each of the colored ink and the transparent ink; therefore, both kinds of ink are formed into the films so that the colored ink layer 92 formed of the colored ink and the transparent ink layer 91 formed of the transparent ink are provided. The colored ink layer 92 and the transparent ink layer 91 are flattened in accordance with the surface of the fixing member 93. Subsequently, the separating temperature (T2) is higher than the minimum film forming temperature (MFT1) of the colored ink and lower than the minimum film forming temperature (MFT2) of the transparent ink. Therefore, the colored ink layer 92 is still soft. Meanwhile, the transparent ink layer 91 is heated to be more than or equal to the minimum film forming temperature of the transparent ink so as to be formed into the film, and then cooled to be lower than the minimum film forming temperature; thus, the transparent ink layer 91 is separated from the fixing member 93 after the layer 91 is sufficiently cured. Thus, the colored ink layer 92, which is still soft, has its surface pulled by the fixing member 93, so that the flatness of the surface of the image deteriorates relatively with respect to the fixing member. On the other hand, the transparent ink layer 91 that is sufficiently cured can be separated from the fixing member 93 with the flat surface shape kept. Therefore, a large gloss difference can be generated between these images.

In addition, it is preferable that the minimum film forming temperature (MFT1) of the colored ink be lower than the minimum film forming temperature (MFT2) of the transparent ink and the image includes the colored ink layer 92 formed of the colored ink and the transparent ink layer 91 formed of the transparent ink on the recording medium in the order from the recording medium side. The image includes the colored ink layer 92 and the transparent ink layer 91 in the order from the recording medium side; therefore, the transparent ink layer with the minimum film forming temperature higher than the separating temperature exists on the colored ink layer 92. As a result, in an area (image part) where the colored ink layer 92 and the transparent ink layer 91 are stacked, when the image is separated from the fixing member, the flatness of the surface of the image does not deteriorate. Therefore, the gloss difference is generated not just between the image part of the transparent ink and the image part of the colored ink but also within the image part of the colored ink depending on the presence or absence of the transparent ink layer.

Thus, the gloss difference is generated when MFT1<T2<MFT2 is satisfied in the above description; however, the gloss difference can be generated also when MFT1>T2>MFT2 in accordance with the mechanism similar to that described with reference to FIG. 1A and FIG. 1B.

The present invention is described below in detail with reference to embodiments.

Note that the term "recording medium" herein used refers to not just paper used in usual printing but also fabric, plastic, films, or other printing media and recording media. Examples of the ink jet recording method according to the present invention include an ink jet recording method in which an image is formed on a transfer body as an ink receiving medium and the image is transferred to a recording medium, and an ink jet recording method in which an image is formed on a recording medium as an ink receiving medium.

Devices used in the respective ink jet recording methods are described below. In the present invention, an ink jet recording device that forms an image on a transfer body and transfers the image onto a recording medium is hereinafter referred to as "transfer type ink jet recording device" for convenience, and an ink jet recording device that forms an image on a recording medium is hereinafter referred to as "direct drawing type ink jet recording device" for convenience.

In the transfer type ink jet recording device, an image as an ink image formed by ink on a transfer body is transferred to a recording medium for forming a printed matter through various processes on the transfer body and finally, a printed matter with a final image is formed.

In the direct drawing type ink jet recording device, image formation and various processes for the image are performed on the recording medium for forming a printed matter, and thus, a printed matter with the final image is formed. In this case, the recording medium itself is a member that forms the printed matter.

(Transfer Type Ink Jet Recording Device)

Figure 2:
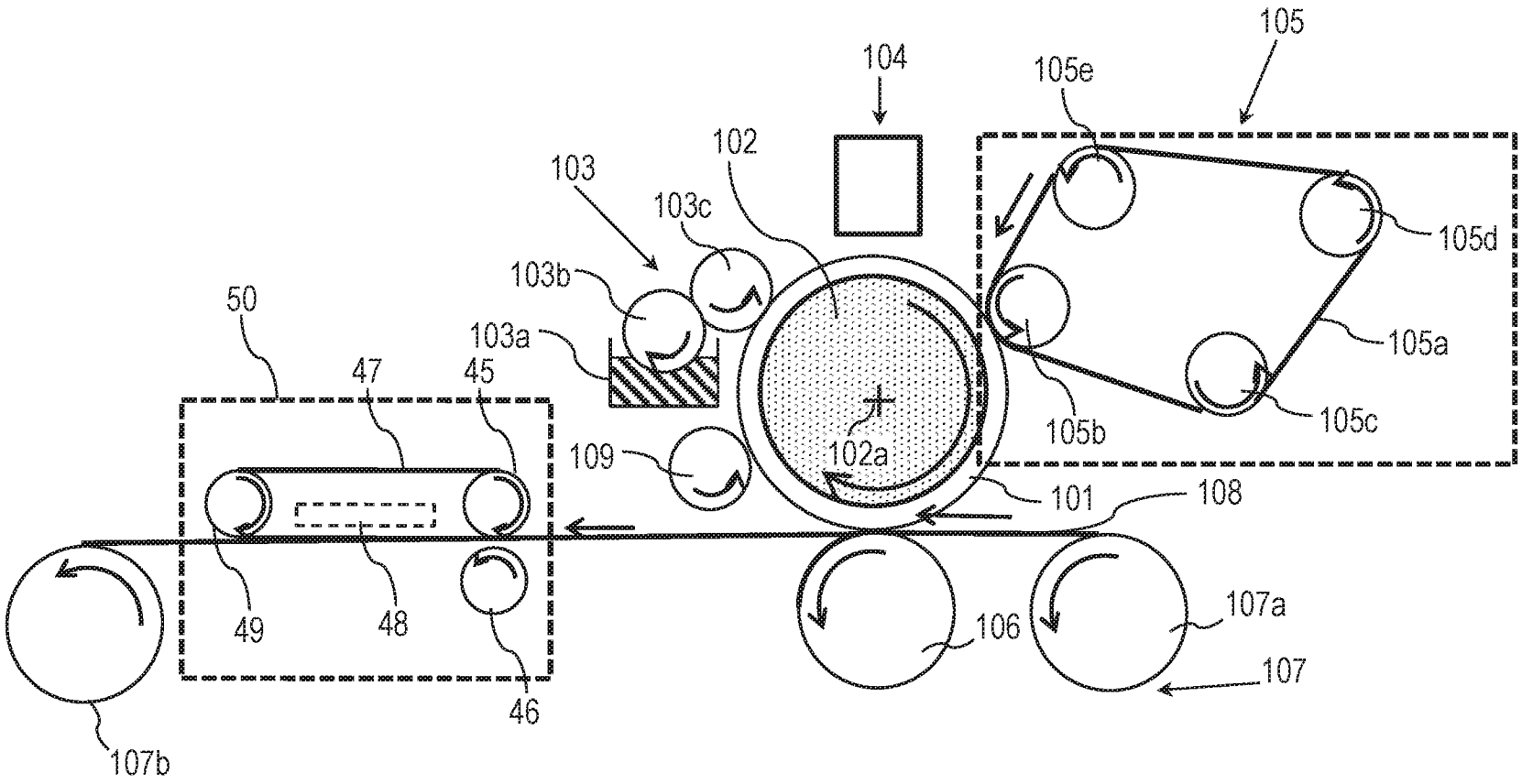
FIG. 2 is a schematic view illustrating one example of a structure of a transfer type ink jet recording device according to one aspect of the present invention.

FIG. 2 is a schematic view illustrating one example of a schematic structure of the transfer type ink jet recording device.

This transfer type ink jet recording device includes a transfer body 101 supported by a support member 102, a reaction liquid applying device 103, an ink applying device 104, a liquid absorbing device 105, a transferring device including a pressing member 106 for transferring, a fixing device 50, and a cleaning device 109. The reaction liquid applying device 103, the liquid absorbing device 105, and the cleaning device 109 can be provided as necessary.

The support member 102 rotates in a direction indicated by an arrow in FIG. 2 with a rotation shaft 102*a* as a center. As the support member 102 rotates, the transfer body 101 is moved. The devices disposed near the transfer body operate in synchronization with the movement of the transfer body. With the operation of the devices, the image is formed on the transfer body 101, various processes for the image are performed, the image is transferred from the transfer body 101 to a recording medium 108, and the transferred image is fixed to the recording medium sequentially; thus, the printed matter with the fixed image is formed.

Specifically, first, the reaction liquid is applied on the transfer body 101 by the reaction liquid applying device 103 and the ink is applied on the transfer body 101 by the ink applying device 104, which are performed sequentially, and thus, the image is formed on the transfer body 101. The order of applying the reaction liquid and the ink is not limited to the order illustrated in the drawing. The reaction liquid and the ink are applied on the transfer body so that these overlap at least partially.

As the transfer body 101 is moved, the image formed on the transfer body 101 is moved to the position where the image is in contact with a liquid absorbing member 105*a* included in the liquid absorbing device 105.

The transfer body 101 and the liquid absorbing device 105 operate in synchronization with each other, and for a while, the image is in contact with the liquid absorbing member 105*a* that moves in synchronization with the transfer body 101. For this while, the liquid absorbing member 105*a* removes at least a part of a liquid component from the image. Note that the liquid component of the image is mostly removed because the image is in contact with the liquid absorbing member 105*a*; in this case, it is particularly preferable that the image be in contact with the liquid absorbing member 105*a* with a predetermined pressure in order to effectively operate the liquid absorbing member 105*a* in the present device structure.

The removal of the liquid component can be expressed from a different point of view as concentrating the ink constituting the image formed on the transfer body. Concentrating the ink means that the proportion of the solid content contained in the ink, such as coloring material and resin, with respect to the liquid component contained in the ink increases owing to reduction in the liquid component.

The image with the liquid component removed therefrom moves to a transfer part that is in contact with the recording medium as the transfer body 101 is moved and then, the image is pressed onto the recording medium that is conveyed to the transfer part by a recording medium conveying device 107. Thus, the image is formed on the recording medium. On the transfer body, after the reaction liquid is applied, the ink is applied to form the image. Therefore, in a no-image area where the image is not formed, the reaction liquid may remain without reacting with the ink. In such a case, in the present device, the liquid absorbing member 105*a* is also in contact (pressure contact) with the reaction liquid that has not reacted and therefore, the liquid absorbing member 105*a* removes not just the liquid component in the image but also the liquid component in the reaction liquid. Therefore, removing the liquid component from the image in the above description does not just mean removing the liquid component only from the image but removing the liquid component at least from the image on the transfer body. The liquid component is not limited to a particular component and may be any component that does not have a constant shape but has fluidity and a substantially constant volume. For example, water, organic solvent, and the like included in the ink or the reaction liquid are given as the liquid component.

When the recording medium 108 with the image formed thereon has reached the position of the fixing device 50 by the recording medium conveying device 107, the image is fixed on the recording medium by the cool separating and fixing step.

Each structure of the transfer type ink jet recording device is described below.

<Transfer Body>

The transfer body 101 includes a surface layer including a surface with an image formation area. The image formation area is an area provided on the surface of the surface layer of the transfer body, and an image may be formed with the ink applied on the entire image formation area or an image may be formed with the ink applied on a part of the image formation area.

As a member of the surface layer, various materials including the resin and the ceramic can be used; in point of durability and the like, the materials with high compressive elastic modulus are preferable. Specific examples include acrylic resin, acrylic silicone resin, fluorine-containing resin, and a condensate resulting from condensation of a hydrolysable organic silicon compound. In order to improve the wettability, the transferring property, or the like of the reaction liquid, the surface layer may be subjected to surface processing. Examples of the surface processing include a frame process, a corona process, a plasma process, a polishing process, a roughening process, an active energy beam irradiation process, an ozone process, a surfactant process, and a silane coupling process. A plurality of kinds of these processes may be employed in combination. The surface layer may have an arbitrary surface shape.

The transfer body preferably includes a compressive layer with a function of absorbing pressure variation. By the provision of the compressive layer, the compressive layer can absorb the deformation, diffuse the local pressure variation, and maintain the excellent transferring property even in the high-speed printing. Examples of the member of the compressive layer include acrylonitrile-butadiene rubber, acrylic rubber, chloroprene rubber, urethane rubber, and silicone rubber. In the molding of the rubber material, it is preferable that a predetermined amount of a vulcanizing agent, a vulcanization accelerator, or the like be mixed and further, filler such as a foaming agent, hollow microparticles, or salt be added as necessary to make the material porous. Thus, in the occurrence of various pressure variations, the foaming part is compressed with the volume change; therefore, the deformation in directions other than the compressing direction is small and the transferring property and the durability can be stabilized. As the porous rubber materials, there are a continuous-pore structure having continuing pores and an independent-pore structure having independent pores. The porous structure may have either structure, or both structures in combination.

The transfer body preferably includes an elastic layer between the surface layer and the compressive layer. Examples of the member of the elastic layer include resin, ceramic, and other various materials as appropriate. In point of processability and the like, various kinds of elastomer materials and rubber materials are used preferably. Specific examples include silicone rubber, fluorosilicone rubber, phenylsilicone rubber, fluorine rubber, chloroprene rubber, urethane rubber, nitrile rubber, ethylene propylene rubber, natural rubber, styrene rubber, isoprene rubber, butadiene rubber, a copolymer of ethylene/propylene/butadiene, and nitrile butadiene rubber. In particular, silicone rubber, fluorosilicone rubber, and phenylsilicone rubber are preferable in point of size stability and durability because the compression set is small. In addition, these rubbers are preferable also in point of transferring property because the change in elasticity depending on temperature is small.

Between the surface layer, the elastic layer, and the compressive layer, various adhesives or double-sided tapes may be used in order to fix and keep these layers. In addition, a reinforcement layer with high compressive elastic modulus may be provided to suppress the lateral extension in the attachment to the device or keep the body. The reinforcement layer may be a fabric. The transfer body can be produced by combining the layers formed of the aforementioned materials as appropriate.

The size of the transfer body can be selected freely in accordance with the size of the intended print image. The transfer body is not limited to a particular shape and may specifically have a sheet shape, a roll shape, a belt shape, or an endless web shape.

<Support Member>

The transfer body 101 is supported on the support member 102. The transfer body may be supported by using various adhesives or a double-sided tape. Alternatively, an installation member formed of metal, ceramic, resin, or the like may be attached to the transfer body and using this installation member, the transfer body may be supported on the support member 102.

The support member 102 is required to have a certain degree of structure strength from the viewpoint of the conveying accuracy and durability.

The material of the support member is preferably metal, ceramic, resin, or the like. Above all, aluminum, iron, stainless steel, acetal resin, epoxy resin, polyimide, polyethylene, polyethylene terephthalate, nylon, polyurethane, silica ceramics, or alumina ceramics is preferably used in order to improve the dimension accuracy or the rigidity enough to withstand the pressure during the transfer and also improve the control responsiveness by reducing the inertia during the operation. It is also preferable to use these materials in combination.

<Reaction Liquid Applying Device>

The reaction liquid applying device 103 that applies the reaction liquid to the transfer body includes a reaction liquid storing part 103*a* that stores the reaction liquid, and reaction liquid applying members 103*b* and 103*c* that apply the reaction liquid, which is in the reaction liquid storing part 103*a*, onto the transfer body 101.

As the reaction liquid applying device, various devices that have conventionally been known can be used as appropriate. Specifically, a liquid applying device including a gravure offset roller or an ink jet head like the reaction liquid applying device 103 illustrated in FIG. 2, a die coater, a blade coater, or the like is given.

The reaction liquid that is applied by the reaction liquid applying device is brought into contact with the ink, which is applied after the reaction liquid is applied on the transfer body, on the transfer body; thus, the viscosity of the ink can be increased.

<Reaction Liquid>

The reaction liquid contains an ink viscosity increasing component. The coloring material, the resin, or the like, which constitutes a part of the composition of the ink, is brought into contact with the ink viscosity increasing component so as to cause the chemical reaction or physical adsorption. The ink viscosity increase includes the viscosity increase of the whole ink by these phenomena and the local viscosity increase due to the aggregation of a part of the components of the ink, for example the coloring material. This ink viscosity increasing component has an effect of decreasing the fluidity of a part of the ink and/or the ink composition on the recording medium so as to suppress the bleeding or beading in the image formation.

In the present invention, the ink viscosity increasing component may be a known material such as polyvalent metal ions, organic acids, cation polymer, or porous microparticles. Among these examples, polyvalent metal ions and organic acids are preferable. In addition, it is preferable to contain a plurality of kinds of ink viscosity increasing components. Note that the reaction liquid contains the ink viscosity increasing component by 5% by mass or more per the total mass of the reaction liquid.

Examples of the polyvalent metal ions include divalent metal ions such as $Ca^{2+}$, $Cu^{2+}$, $Ni^{2+}$, $Mg^{2+}$, $Sr^{2+}$, $Ba^{2+}$, and $Zn^{2+}$, and trivalent metal ions such as $Fe^{3+}$, $Cr^{3+}$, $Y^{3+}$, and $Al^{3+}$. Examples of the organic acids include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pylon carboxylic acid, pyrrole carboxylic acid, furan carboxylic acid, pyridine carboxylic acid, coumaric acid, thiophene carboxylic acid, nicotinic acid, hydroxysuccinic acid, and dihydroxysuccinic acid.

The reaction liquid may contain a proper amount of water or organic solvent. The water used in this case is preferably water deionized through ion exchange or the like. The organic solvent that can be used for the reaction liquid is not limited to a particular kind and may be known organic solvent.

The reaction liquid may additionally contain surfactant or viscosity improver in order to adjust its surface tension or viscosity as appropriate. The material used is not limited to a particular material and may be any material that can coexist with the ink viscosity increasing component. Specific examples of the surfactant include acetylene glycol ethylene oxide addition (product name: ACETYLENOL E100, Kawaken Fine Chemicals Co., Ltd.), and perfluoroalkylethylene oxide addition (product name: MEGAFACE F444, DIC Corporation).

<Ink Applying Device>

The ink applying device 104 that applies the ink is an ink applying device with an ink jet head. The ink jet head may be in a mode of, for example, ejecting ink by boiling an ink film with an electrothermal converter to foam the film, ejecting ink with an electromechanical converter, or ejecting ink with static electricity. Any known ink jet head can be used. Among these, it is particularly preferable to use an electrothermal converter from the viewpoint of forming an image with high density at high speed. Drawing is performed by receiving an image signal and applying a necessary amount of ink at each position.

The amount of ink applied can be expressed by the image density (duty) or the ink thickness; here, the mass of each ink dot is multiplied by the number of dots and then, the obtained product is divided by the print area, and the obtained average value is employed as the amount of ink to be applied ($g/m^2$). Note that the maximum amount of ink to be applied in the image area refers to the amount of ink applied in an area of at least 5 $mm^2$ or more in an area used as the information of the recording medium from the viewpoint of removing the liquid component in the ink.

In order to apply the colored ink and the transparent ink on the transfer body 101, the ink applying device 104 includes a plurality of ink jet heads. In addition, in a case of using a plurality of kinds of colored ink, the same number of ink jet heads as the number of colors are prepared. For example, in the case of forming an image using yellow ink, magenta ink, cyan ink, and black ink, the ink applying device 104 includes four ink jet heads that eject these four kinds of colored ink onto the transfer body.

<Ink>

(Colored Ink)

The components of the colored ink are hereinafter described.

(Coloring Material)

The coloring material contained in the colored ink may be pigment or a mixture of pigment and dye. The kind of pigment that can be used as the coloring material is not limited to a particular kind. Specific examples of the pigment include inorganic pigment such as carbon black, and organic pigment such as azo, phthalocyanine, quinacridone, isoindolinone, imidazolone, diketopyrrolopyrrole, and dioxazine. One kind or two or more kinds of pigment can be used as necessary.

The kind of dye that can be used as the coloring material is not limited to a particular kind. Specific examples of the dye include direct die, acid die, basic dye, disperse dye, and food color, and for example, dye with an anionic group can be used. Specific examples of the dye skeleton include azo, triphenylmethane, phthalocyanine, azaphthalocyanine, xanthene, and anthrapyridone.

The colored ink contains the coloring material by preferably 0.5% by mass or more and 15.0% by mass or less, more preferably 1.0% by mass or more and 10.0% by mass or less per the total mass of the ink.

(Dispersant)

The dispersant that disperses the pigment may be a known dispersant that is used for the ink jet. Above all, it is preferable to use a water-soluble dispersant having both a hydrophilic part and a hydrophobic part in a structure. It is particularly preferable to use a pigment dispersant formed of resin resulting from copolymerization with at least hydrophilic monomer and hydrophobic monomer. The monomer used here is not limited to a particular monomer and may be any known monomer. Specific examples of the hydrophobic monomer include styrene, styrene derivative, alkyl(meth) acrylate, and benzyl(meth)acrylate. Specific examples of the hydrophilic monomer include acrylic acid, methacrylic acid, and maleic acid.

The dispersant has an oxidation number of preferably 50 mgKOH/g or more and 550 mgKOH/g or less. The weight-average molecular weight of the dispersant is preferably 1000 or more and 50000 or less. Note that the mass ratio between the pigment and the dispersant (pigment: dispersant) is preferably in the range of 1:0.1 to 1:3.

A self-dispersible pigment, which has its surface modified to enable the dispersion, may be used instead of using the dispersant.

(Resin Particle)

The colored ink contains the resin (first resin) free of the coloring material as the component to form the film of the ink in the cool separating and fixing step. The resin for forming the film is preferably included in the colored ink in the form of resin particles. It is preferable to use the resin as the resin particles because the image quality or the fixing property may be improved.

The material of the resin particle is not limited to a particular material and may be known resin. Specific examples include homopolymer such as polyolefin, polystyrene, polyurethane, polyester, polyether, polyurea, polyamide, polyvinyl alcohol, poly(meth)acrylic acid, a salt thereof, poly(meth)acrylate alkyl, and polydiene, and copolymer resulting from polymerization of a plurality of monomers for generating these homopolymers. The weight-average molecular weight (Mw) of the resin is preferably in the range of 1000 or more and 2000000 or less. The colored ink contains the resin particles by preferably 1% by mass or more and 50% by mass or less, more preferably 2% by mass or more and 40% by mass or less per the total mass of the ink.

The resin particles are preferably used as a resin particle dispersed body in which the resin particles are dispersed in liquid. The method of dispersion is not limited to a particular method, and it is preferable to use a self-dispersible resin particle dispersed body in which the monomer with a dissociation group is homopolymerized or copolymerized with a plurality of kinds. Here, the dissociation group may be a carboxyl group, a sulfonic acid group, a phosphoric acid group, or the like, and the monomer with the dissociation group may be acrylic acid, methacrylic acid, or the like. The resin particle dispersed body of an emulsified and dispersed type, in which the resin particles are dispersed by an emulsifier, can also be used similarly. The emulsifier here is preferably a known surfactant regardless of whether it has low molecular weight or high molecular weight. The surfactant is preferably a nonionic surfactant or a surfactant with the same charge as the resin particles. The resin particle dispersed body has a dispersion particle diameter of preferably 10 nm or more and 1000 nm or less, more preferably 100 nm or more and 500 nm or less. When the resin particle dispersed body is produced, various additives are preferably added for stabilization. Preferable examples of the additives include n-hexadecane, dodecyl methacrylate, stearyl methacrylate, chlorobenzene, dodecylmercaptane, blue dye (bluing agent), and polymethyl methacrylate.

(Wax Particles)

The colored ink may contain wax. By using wax and the resin particles together, the difference between the minimum film forming temperature of the colored ink and the separating temperature in the cool separating and fixing step can be reduced.

The wax is preferably used in the form of particles.

Examples of the wax component included in the wax particles include natural wax and synthetic wax. Examples of the natural wax include petroleum wax, vegetable wax, and animal and vegetable wax.

Examples of the petroleum wax include paraffin wax, microcrystalline wax, and petrolatum.

Examples of the vegetable wax include carnauba wax, candelilla wax, rice wax, and vegetable tallow.

Examples of the animal and vegetable wax include lanoline and beeswax.

Examples of the synthetic wax include synthetic hydrocarbon wax and modified wax.

Examples of the synthetic hydrocarbon wax include polyethylene wax and Fischer-Tropsch wax.

Examples of the modified wax include paraffin wax derivative, montan wax derivative, and microcrystalline wax derivative.

Any of these examples may be used alone or two or more kinds thereof may be used in combination.

The wax particles are preferably used to prepare the colored ink in a state of a wax particle dispersed body having wax particles dispersed in liquid. The wax particles are preferably formed by dispersing the wax component with the dispersant. The dispersant is not limited to a particular kind, and may be, for example, a known dispersant. It is preferable to select the kind of the dispersant in consideration of the stability of the dispersion state of the wax particles in the colored ink. The water-soluble resin that functions as the dispersant described above may be used as the dispersant for the wax particles.

The volume-average particle diameter of the wax particles is preferably 10 nm or more and 1000 nm or less, and more preferably 50 nm or more and 500 nm or less.

In the case of adding the water-soluble resin as the dispersant to the colored ink, the content is preferably in the range of 0.1% by mass or more and 20% by mass or less, more preferably 0.1% by mass or more and 10% by mass or less, and much more preferably 0.1% by mass or more and 5% by mass or less per the total mass of the colored ink.

By regulating the content of the water-soluble resin within this range, the characteristics when the colored ink is ejected from the ink jet head, such as ejecting stability and landing position accuracy of the ejected droplet, can be improved.

The wax particles are preferably contained in the range of 0.5% by mass or more and 20% by mass or less, more preferably 1% by mass or more and 10% by mass or less per the total mass of the colored ink. The mass ratio between the water-soluble resin and the wax particles (water-soluble resin:wax particles) is preferably selected from the range of 3:1 to 1:10, and more preferably 1:1 to 1:10.

The mass ratio between the resin particles and the wax particles (resin particles: wax particles) is preferably selected from the range of 10:1 to 1:20, and more preferably 5:1 to 1:10. By selecting the ratio between the resin particles and the wax particles from within this range, the resin particles can be used more effectively.

The wax particles have a melting point (Tm) of preferably 40° C. or more and 150° C. or less.

(Surfactant)

The colored ink may contain the surfactant. Specific examples of the surfactant include acetylene glycol ethylene oxide addition (product name: ACETYLENOL E100, Kawaken Fine Chemicals Co., Ltd.). The amount of surfactant in the colored ink is preferably 0.01% by mass or more and 5.0% by mass or less per the total mass of the ink.

(Water and Water-Soluble Organic Solvent)

The colored ink may contain water and/or water-soluble organic solvent as the solvent. Water is preferably water deionized through ion exchange or the like. The colored ink contains water by preferably 30% by mass or more and 97% by mass or less per the total mass of the ink.

The water-soluble organic solvent is not limited to a particular kind and may be any known organic solvent. Specific examples include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. Two or more kinds selected from these examples may be used in mixture.

The colored ink contains the water-soluble organic solvent by preferably 3% by mass or more and 70% by mass or less per the total mass of the ink.

(Other Additives)

The colored ink may contain various additives such as pH conditioner, corrosion inhibitor, preservative, an antifungal agent, an antioxidant, reduction inhibitor, water-soluble resin, a neutralizer thereof, or viscosity modifier.

(Transparent Ink)

The transparent ink can be prepared by the composition similar to that of the colored ink except that the coloring material is not used. Note that the resin included in the transparent ink is also referred to as the second resin. As the kind of the second resin, the examples shown above as the first resin included in the colored ink can be used. The second resin is preferably the resin particles similarly to the first resin.

<Minimum Film Forming Temperature>

The minimum film forming temperature (MFT) in the present invention means the temperature at which, if the ink of an image formed on the recording medium that is before being fixed is heated, the component for forming the film, for example, the resin component included in the ink is melted or softened so that the ink becomes the film form. The ink that forms the image before the fixing process may be in the form of having high viscosity, the form of the ink aggregation layer including the aggregated solid component, or the form of the mixture of the both.

Examples of the method for measuring the MFT include a method of changing the heating temperature gradually for the ink layer containing the resin component formed on the recording image and comparing the coloring property of each sample. Heating at high temperature can improve the coloring property because the resin component in the ink layer, which is heated at high temperature, is melted or softened into the film, and thus the gaps that used to exist in the ink layer disappear, resulting in less scattering of light. Using this phenomenon, the minimum film forming temperature of the ink itself can be known. If it is difficult to perform the evaluation in the ink, the resin particles in the ink are used and those resin particles are heated with a proper temperature gradient in accordance with JIS K 6828-2:2003 "determination of white point temperature and minimum film-forming temperature" and the border temperature between a transparent part where the film is formed and a part where the film is not formed may be measured.

<Image Forming Step>

In the ink jet recording method using the transfer type ink jet recording device, the image forming step includes: an ink applying step of applying colored ink and transparent ink on a transfer body so as to form an intermediate image and a transferring step of transferring the intermediate image from the transfer body to the recording medium so as to form the image on the recording medium.

This image forming step preferably includes a reaction liquid applying step of applying the reaction liquid that increases the viscosity of the colored ink and/or the transparent ink so as to at least partially overlap with at least one of an area of the transfer body where the colored ink is applied and an area thereof where the transparent ink is applied.

If an image including the colored ink layer and the transparent ink layer in the order from the recording medium side is formed on the recording medium, the intermediate image is formed by applying the transparent ink on the transfer body and applying the colored ink so as to overlap at least partially with the area where the transparent ink is applied. Thus, the intermediate image including the transparent ink layer and the colored ink layer in the order from the transfer body side is formed on the transfer body and by the subsequent transferring step, the image including the colored ink layer and the transparent ink layer in this order from the recording medium side can be formed on the recording medium.

<Liquid Component Removing Step>

In order to enhance the robustness of the image fixed on the recording medium or the gloss of a glossy part, it is preferable to remove at least a part of the liquid included in the image formed on the transfer body. The liquid may be removed by a method of drying to accelerate the water vaporization with heat or wind, a method using a liquid absorbing device that absorbs the liquid component in contact with the image, or the like.

The liquid absorbing device is hereinafter described.

<Liquid Absorbing Device>

With the liquid absorbing device 105, at least a part of the liquid component is removed from the image with the viscosity increased in the reaction with the reaction liquid. Thus, the image disturbance such as curling or cockling after the image is transferred to the recording medium such as paper due to the liquid component remaining in the image, or offset of an image to an overlapped sheet can be suppressed.

The liquid absorbing device 105 includes the liquid absorbing member 105*a*, and a pressing member 105*b* for absorbing liquid, and the pressing member 105*b* presses the liquid absorbing member 105*a* onto the image on the transfer body 101. The shape of the liquid absorbing member 105*a* and the pressing member 105*b* is not limited in particular. For example, as illustrated in FIG. 2, the pressing member 105*b* may have a circular columnar shape and the liquid absorbing member 105*a* may have a belt shape, and the pressing member 105*b* with the circular columnar shape may press the liquid absorbing member 105*a* with the belt shape onto the transfer body. In another example, the pressing member 105*b* may have a circular columnar shape and the liquid absorbing member 105*a* may have a cylindrical shape formed on the peripheral surface of the pressing member 105*b* with the circular columnar shape, and the pressing member 105*b* with the circular columnar shape may press the liquid absorbing member 105*a* with the cylindrical shape onto the transfer body. In addition, the liquid absorbing device 105 may have an extending member that extends the liquid absorbing member. In FIGS. 2, 105*c*, 105*d*, and 105*e* denote extending rollers as the extending members.

In the liquid absorbing device, the liquid absorbing member 105*a* with a porous body is pressed onto the image by the pressing member 105*b*; thus, the liquid component in the image is absorbed by the liquid absorbing member 105*a* and at least a part of the liquid component is removed from the image. Examples of the method for removing the liquid component from the image include the present method of pressing the liquid absorbing member 105*a* and other various methods that have been conventionally employed, including a method by heating, a method of sending wind with low water content, and a method of reducing pressure. Conditions and structures of the liquid absorbing device are hereinafter described in detail.

(Pretreatment)

Figure 3:
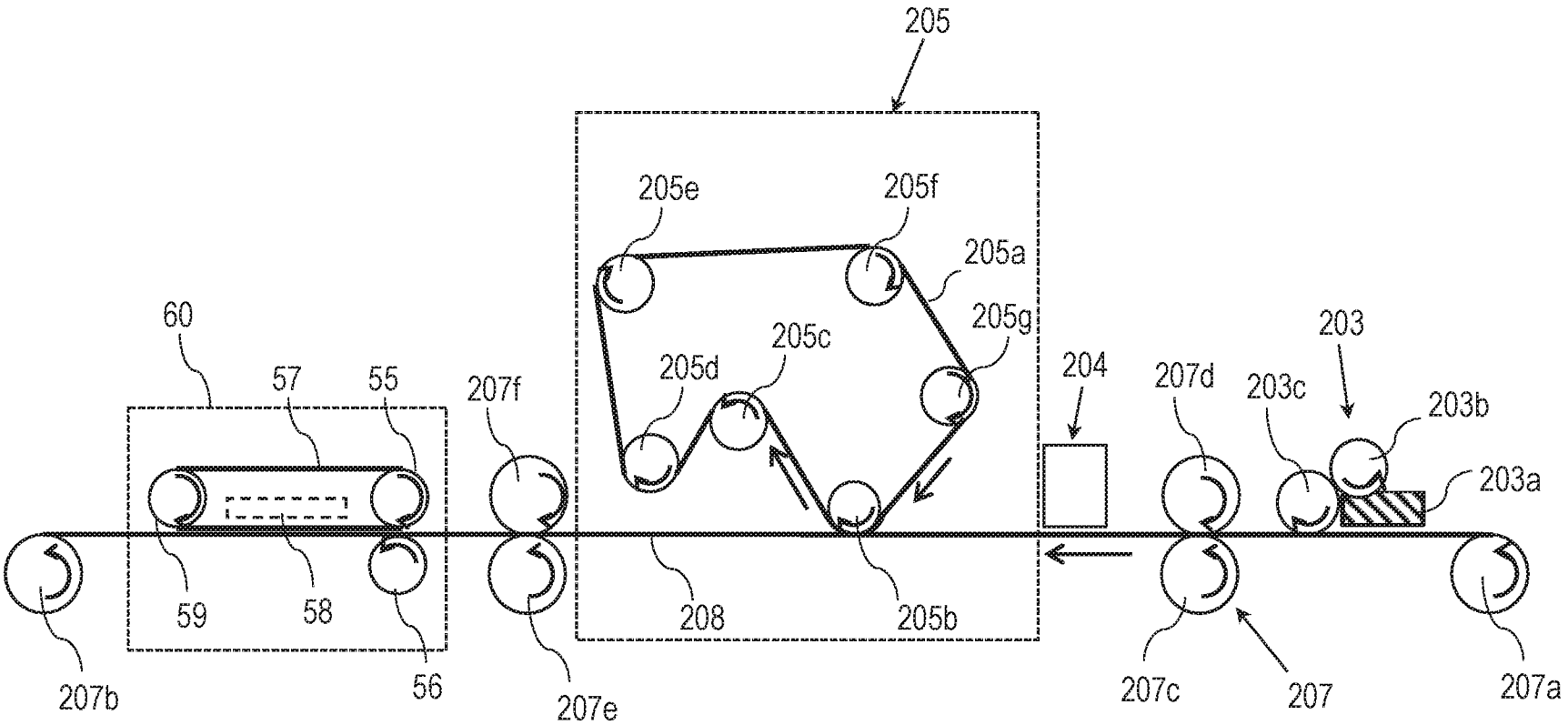
FIG. 3 is a schematic view illustrating one example of a structure of a direct drawing type ink jet recording device according to one aspect of the present invention.

Before the liquid absorbing member with the porous body is brought into contact with the image, it is preferable to perform pretreatment by applying a treatment liquid on the liquid absorbing member by the use of a pretreatment device (not illustrated in FIG. 2 or FIG. 3). The treatment liquid for the pretreatment preferably contains water and water-soluble organic solvent. The water is preferably water that is deionized through ion exchange or the like. The water-soluble organic solvent is not limited to a particular kind, and may be any known organic solvent such as ethanol or isopropyl alcohol. In the pretreatment for the liquid absorbing member, the method of applying the treatment liquid for pretreatment is not limited to a particular method and is preferably immersion or liquid dripping.

(Pressing Condition)

The liquid absorbing member that is in pressure contact with the image on the transfer body is preferably 0.3 $kgf/cm^2$ or more because the liquid in the image can be separated from solid in a shorter time and the liquid component can be removed from the image. The pressure of the liquid absorbing member corresponds to the nip pressure between the transfer body 101 and the liquid absorbing member 105*a*, and the surface pressure is measured using a surface pressure distribution measuring device (I-SCAN, produced by NITTA Corporation) and the weight in the pressed area is divided by the area to obtain the value.

(Operation Time)

The operation time for which the liquid absorbing member 105*a* is in contact with the image is preferably within 50 ms in order to suppress the adhesion of the coloring material in the image to the liquid absorbing member further. This operation time is calculated by dividing the pressure sensing width in the moving direction of the transfer body 101 in the surface pressure measurement described above by the moving speed of the transfer body 101. This operation time is referred to as liquid absorbing nip time.

(Method for Removing Liquid from Liquid Absorbing Member)

The liquid component absorbed from the image by the liquid absorbing member can be removed from the liquid absorbing member 105*a* by a known method. Examples thereof include a method by heating, a method of sending wind with low water content, and a method of squeezing the porous body.

(Porous Body)

The porous body of the liquid absorbing member 105*a* preferably has smaller pore diameter in order to suppress the adhesion of the ink coloring material to the porous body, and the pore diameter of the porous body at least on the side in contact with the image is preferably 10 μm or less. Note that the pore diameter is the average diameter that can be measured by a known method such as a method of mercury penetration, a nitrogen adsorption method, or an SEM image observation.

In order to achieve uniformly high gas permeability, the porous body is preferably thinner. The gas permeability is expressed by the Gurley value defined in JIS P8117, and the Gurley value is preferably 10 seconds or less. The porous body is not limited to a particular shape and may have a roller shape, a belt shape, or the like.

However, the thin porous body may fail to have the capacity enough to absorb the liquid component; therefore, the porous body may have a multilayer structure including a plurality of layers. In addition, the liquid absorbing member 105*a* only needs to have the layer, which is in contact with the image on the transfer body, as the porous body and the layer that is not in contact with the image on the transfer body does not need to be the porous body.

Next, an embodiment in which the porous body has the multilayer structure is described. In the description below, a layer on the side in contact with the transfer body is referred to as a first layer, and a layer below the first layer, that is, stacked on a surface of the first layer opposite to a surface thereof in contact with the transfer body is referred to as a second layer. For more layers, the layers are described in the order of stacking from the first layer. Note that the first layer may be herein described as "absorption layer" and the layers subsequent to the first layer may be herein described as "support layer". If the porous body has a single-layer structure, the porous body can be formed of a single layer of a material for the first layer that is described below.

[First Layer]

The material of the first layer is not limited to a particular material and is preferably fluorine resin with low surface free energy from the viewpoint of suppressing the adhesion of the coloring material and improving the cleaning property. Specific examples of the fluorine resin include polytetrafluoroethylene (PTFE), polychlorotrifluoroethylene (PCTFE), polyvinylidene fluoride (PVDF), polyvinyl fluoride (PVF), perfluoroalkoxy fluorine resin (PFA), tetrafluoroethylene-hexafluoropropylene copolymer (FEP), ethylene-tetrafluoroethylene copolymer (ETFE), and ethylene-chlorotrifluoroethylene copolymer (ECTFE). Any one kind, or two or more kinds of the resin may be used, and the first layer may include a stack of films.

The first layer of the porous body on the side in contact with the image has a pore diameter of preferably 10 μm or less from the viewpoint of the adhesion of the coloring material when in pressure contact with the image. The first layer has a thickness of preferably 50 or less, more preferably 30 μm or less. The film thickness can be obtained by measuring the thickness of ten arbitrary points with the use of a straight advance type micrometer OMV_25 (product name, produced by Mitsutoyo Corporation) and calculating the average value thereof

[Second Layer]

The second layer is preferably a layer with gas permeability. The second layer may be either a nonwoven fabric or a woven fabric. The material of the second layer is not limited to a particular material and is preferably a single material or a composite material including polyolefin (such as polyethylene (PE) or polypropylene (PP)), polyurethane, nylon, polyamide, polyester (such as polyethylene terephthalate (PET)), polysulfones (PSF), or the like.

[Third Layer]

The porous body with the multilayer structure may have three or more layers and the number of layers is not limited to a particular value. The third layer is preferably a nonwoven fabric from the viewpoint of the rigidity. The third layer may be formed of a material similar to that of the second layer.

[Method for Producing Porous Body]

A method for forming the porous body by stacking the first layer and the second layer is not limited to a particular method. The first layer and the second layer may be simply overlapped on each other or may be attached together by a method of adhesive lamination or thermal lamination, for example. From the aspect of the gas permeability, thermal lamination is preferred. In another example, the first layer or the second layer may be partially melted by heating to form the adhesive lamination. In still another example, a melting material such as hot melt powder may be provided between the first layer and the second layer and by heating, the adhesive lamination may be formed. If three or more layers are stacked, these layers may be stacked at one time or stacked sequentially; the order of stacking is selected as appropriate.

In the heating step, it is preferable to use a laminating method in which the porous body is heated while the porous body is held and pressed by heated rollers.

<Transferring Device>

The image on the transfer body is transferred onto the recording medium 108 conveyed by the recording medium conveying device 107 in a manner that the image is pressed on the recording medium by a pressing roller as the pressing member 106 for transferring. After the liquid component is removed from the image on the transfer body, the image is transferred to the recording medium; thus, the recording image with the curling or cockling suppressed can be obtained. The pressing member of the transferring device is not limited to the pressing roller and may be other pressing member than the pressing roller.

The transferring device in the drawing includes the support body of the transfer body, the pressing roller, and a driving device for those.

The pressing member for transferring is required to have a certain degree of structure strength from the viewpoint of the durability and the conveying accuracy for the recording medium. The pressing member is preferably formed of metal, ceramic, resin, or the like. Above all, aluminum, iron, stainless steel, acetal resin, epoxy resin, polyimide, polyethylene, polyethylene terephthalate, nylon, polyurethane, silica ceramics, or alumina ceramics is preferably used for improving the dimension accuracy, the rigidity enough to withstand the pressure in the transfer, and the responsiveness in control by reducing the inertia in the operation. These materials may be used in combination. The time for which the image on the transfer body is pressed on the recording medium is not limited to a particular length of time; however, the time is preferably 5 ms or more and 100 ms or less in order to perform the transfer smoothly and not to deteriorate the durability of the transfer body. The pressing time corresponds to the time for which the recording medium and the transfer body are in contact, and is obtained by measuring the surface pressure with the surface pressure distribution measuring device (I-SCAN, produced by NITTA Corporation) and dividing the length of the pressed area in the conveying direction by the conveying speed.

The pressure of pressing the image on the transfer body onto the recording medium is not limited to a particular pressure either; however, the pressure is preferably 1 $kg/cm^2$ or more and 30 $kg/cm^2$ or less in order to perform the transfer smoothly and not to deteriorate the durability of the transfer body. The pressure in this pressing operation corresponds to the nip pressure between the recording medium and the transfer body. The surface pressure is measured using the aforementioned surface pressure distribution measuring device and the weight in the pressed area is divided by the area to obtain the value. The temperature when the image on the transfer body is pressed on the recording medium is not limited to a particular temperature and may be any temperature that can obtain the intended transferring property, for example. It is preferable to include a heating device that heats the image on the transfer body, the transfer body, and the recording medium.

<Recording Medium and Recording Medium Conveying Device>

The recording medium 108 is not limited to a particular medium and may be any known recording medium. The recording medium may have a rolled shape or a batch shape. Examples of the material include paper, a plastic film, a wood plate, cardboard, and a metal film.

In FIG. 2, the recording medium conveying device 107 for conveying the recording medium includes a recording medium feeding roller 107*a* and a recording medium winding roller 107*b*; however, it is only necessary that the recording medium can be conveyed and the recording medium conveying device 107 is not limited to this structure.

<Fixing Device>

The image formed on the recording medium is subjected to the fixing process so that the image formed on the recording medium is fixed onto the recording medium and the image becomes glossy.

As the fixing device for the fixing process, a cool separating and fixing device is used. The cool separating and fixing device, which is described in detail below, applies pressure on the recording medium with heat by the use of the fixing member and after cooling, separates the fixing member from the image on the recording medium.

(Cool Separating and Fixing Device)

Figure 7:
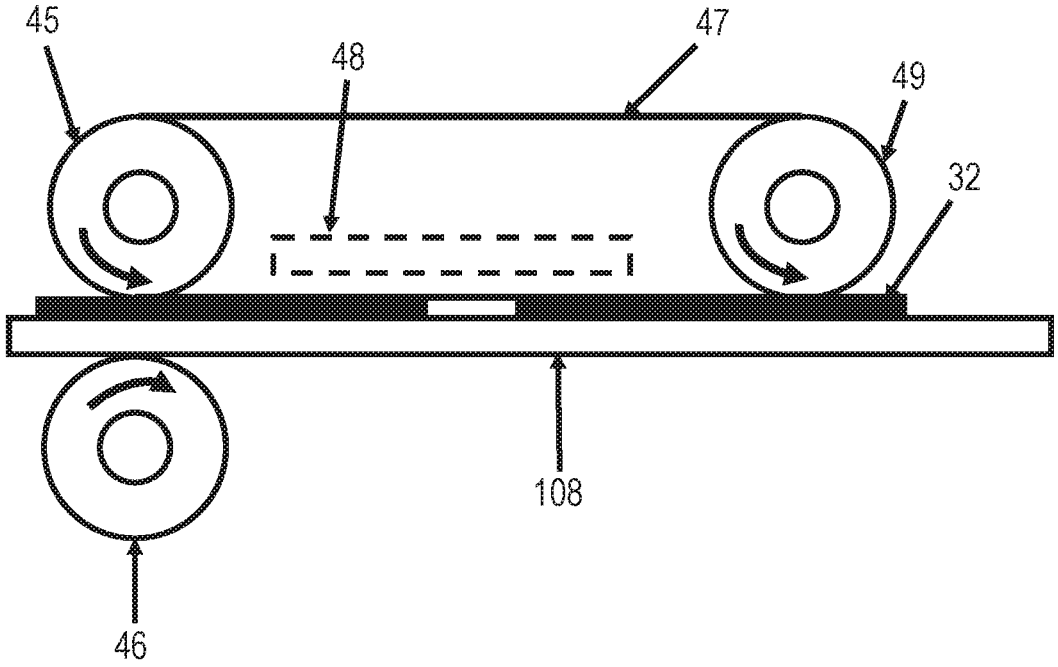
FIG. 7 is a schematic view illustrating an entire structure of a cool separating and fixing device in one embodiment of the present invention.

FIG. 7 is a schematic view illustrating a schematic structure of one example of the cool separating and fixing device.

As illustrated in FIG. 7, the cool separating and fixing device includes a heating roller 45, a separating roller 49, and a fixing member 47 with an endless belt shape that is looped between these two rollers. At a position facing the heating roller 45, a pressing roller 46 is provided. Between the pressing roller 46 and the fixing member 47 that is conveyed so as to be wound around an outer peripheral surface of the heating roller 45, a nip part is formed. Between the heating roller 45 and the separating roller 49, a cooling device 48 that cools the fixing member 47 is provided.

As an image 32 formed on the recording medium 108 passes the nip part formed by the pressing roller 46 and the fixing member 47 that is wound around the heating roller 45, the image 32 is heated and pressed. Thus, a predetermined part of the surface of the image 32 can be flattened in accordance with the surface of the fixing member 47. Until reaching the position of the separating roller 49, the fixing member 47 and the image 32 remain in contact with each other and are cooled by the cooling device 48 and conveyed to the separating roller 49. The direction of conveying the fixing member 47 after the separating roller 49 changes into a direction different from the direction of conveying the recording medium 108 with the image 32 in accordance with the outer peripheral surface of the separating roller, and thus, the fixing member 47 is separated from the recording medium 108.

Note that the cool separating and fixing device only need to have a structure that can be used in the intended fixing step, that is, a structure in which the fixing member and the image, which remain in contact with each other, are heated and pressed and after cooling, the fixing member is separated. Thus, the cool separating and fixing device is not limited to the structure including the fixing member with the endless belt shape illustrated in FIG. 7.

(Pressing Temperature)

Figure 8:
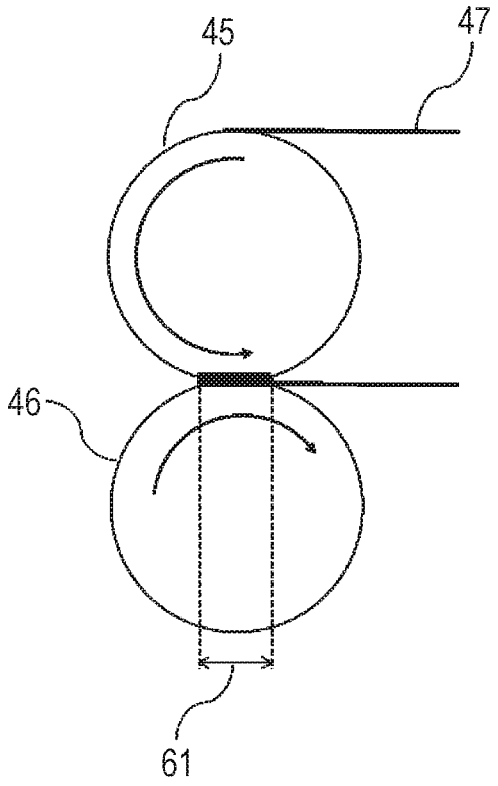
FIG. 8 is a schematic view illustrating a structure of a heating and pressing part of the cool separating and fixing device illustrated in FIG. 7.

FIG. 8 is a schematic view illustrating a structure of a heating and pressing part in the cool separating and fixing device illustrated in FIG. 7. In the present invention, the pressing temperature corresponding to the temperature of the surface of the fixing member when the image is pressed and heated is the maximum temperature of the image in a pressure applying part 61 that applies pressure to the image by the use of the heating roller 45 and the pressing roller 46 as illustrated in FIG. 7.

Figure 9:
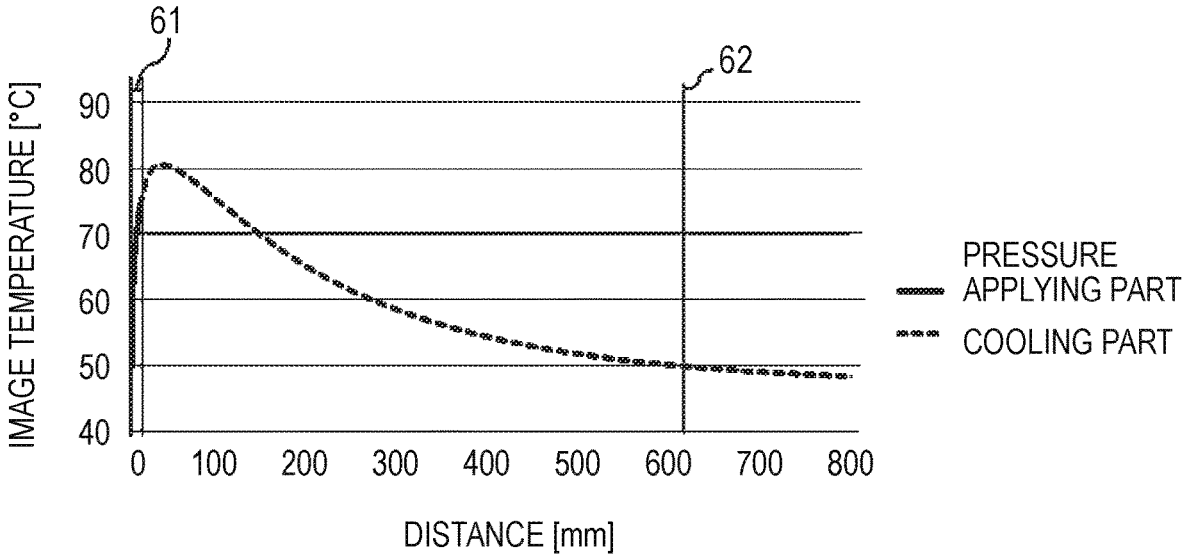
FIG. 9 is a graph illustrating a temperature profile in an image part in a cool separating and fixing step in one embodiment of the present invention.

FIG. 9 is a graph illustrating one example of the temperature profile of an image in the cool separating and fixing device. In the example in FIG. 9, the temperature of the image rises as heat is conducted from the heating roller 45 in the pressure applying part 61, and the image just before passing the pressure applying part 61 is 75° C. However, even after passing the pressure applying part, the image is heated further with the heat from the fixing member and the temperature of the image reaches 80° C. or more. Even in this case, the pressing temperature is the maximum temperature in the pressure applying part and is therefore 75° C. The pressing temperature is set higher than the minimum film forming temperature of the ink that forms the image part with high gloss, and is preferably 10° C. or more higher than the minimum film forming temperature. The pressing temperature is preferably selected from the range of 60 to 120° C. in consideration of the damage on the recording medium or the adhesion of the fixing member though the pressing temperature depends on the minimum film forming temperature of the resin particles included in the ink, for example. The temperature of the image in the heating and pressing is obtained by measuring the temperature of the ink film (image) that forms the image on the recording medium just after the pressing by the use of a noncontact thermometer (product name: IT-314, AS ONE Corporation). Note that the temperature of this image is the same as the temperature (pressing temperature T1) of the surface of the fixing member.

(Cooling Method)

A cooling method for the fixing member 47 and the recording medium 108 including the image 32 is not limited to a particular method and may be any method that enables the separation at desired separating temperature in consideration of the conveying speed and the device size. The cooling method can be selected from among various cooling methods including natural cooling, air cooling, water cooling, or contact cooling.

(Separating Temperature)

The separating temperature in the present invention is the temperature at the time when the fixing member 47 and the image 32 are separated. For example, FIG. 9 illustrates the image temperature profile in the case where the distance between an end of the pressure applying part (the position just after the image is brought into contact with the fixing member) and a separating part 62 is 600 mm; therefore, the image temperature 50° C. at 600 mm is regarded as the separating temperature.

Additionally, in order to achieve the effect of the present invention, the separating temperature is set between the minimum film forming temperatures of two kinds of ink. In order to increase the gloss difference between a part with high gloss and a part with low gloss, the separating temperature is set to be lower than the minimum film forming temperature of the ink that forms the image part that exhibits high gloss and higher, preferably 10° C. or more higher, than the minimum film forming temperature of the ink that forms the image part that exhibits low gloss.

The separating temperature is preferably selected from the temperatures less than or equal to 60° C. in consideration of the adhesion of the ink to the fixing member though the separating temperature depends on the minimum film forming temperature of the resin particles in the ink, the pressing temperature, or the like. The temperature of the image at the separating is obtained by measuring the temperature of the ink film (image) that forms the image on the recording medium just after the separating by the use of the noncontact thermometer (product name: IT-314, AS ONE Corporation). Note that the temperature of this image is the same as the temperature (separating temperature T2) of the surface of the fixing member.

(Fixing Pressure)

The fixing pressure as the pressure that the fixing member applies on the image may be the pressure that can flatten the image part sufficiently and is not limited to a particular value. The pressure that is measured by the surface pressure distribution measuring device (I-SCAN, produced by NITTA Corporation) is preferably the pressure selected from the range of 1 to 20 kgf/cm$^2$, and more preferably 3 to 5 kgf/cm$^2$.

(Fixing Member)

The physical properties of the fixing member 47 include mainly the surface free energy, flatness, hardness, thickness, and the like. The physical properties of the fixing member are not limited to particular values and may be any value that enables the image to have the intended gloss. In order for the image part with the high gloss to have much higher gloss, the surface free energy of the fixing member is preferably 15 to 50 mN/m, more preferably 20 to 35 mN/m, in the contact angle meter/surface free energy analyzer (KRUSS). Additionally, in order for the image part with the high gloss to have much higher gloss, the surface of the fixing member that is in contact with the image is preferably flat. Therefore, the fixing member has a surface roughness (arithmetic mean roughness) Ra of preferably 0.1 μm or less in accordance with JIS B0601. The lower limit value of the surface roughness of this fixing member is 0 μm. The hardness is preferably more than the hardness of the image part when the pressure is applied, and especially, the Young's modulus is preferably 1 GPa or more. Examples of the fixing member include a resin film such as a polyimide film, or a sheet or a belt made of metal such as stainless steel or aluminum.

(Pressing Temperature and Separating Temperature)

By setting various conditions regarding parameters about temperature as below, the gloss difference between the image parts can be controlled and the quality of the glossy image can be varied more widely.

The minimum film forming temperature MFT1 of the image part formed of the colored ink in the image before the fixing process The minimum film forming temperature MFT2 of the image part formed of the transparent ink in the image before the fixing process Pressing temperature T1 in the cool separating and fixing step Separating temperature T2 in the cool separating and fixing step Embodiments about the setting of these parameters are described below.

(A) Image formation under condition MFT1<MFT2

The condition including the parameters when MFT1<MFT2 is as below.

$$T1>\mathrm{MFT2}>\mathrm{MFT1}$$

$$\mathrm{MFT2}>T2>\mathrm{MFT1}$$

In the fixed image obtained under the above condition, the gloss of the image part 92 formed of the colored ink becomes lower than that of the image part 91 formed of the transparent ink as described with reference to FIG. 1B.

In order to increase the gloss difference between these image parts, the following condition is additionally satisfied.

$$T1>(\mathrm{MFT2}+10^\circ\ \mathrm{C.})$$

$$T2>(\mathrm{MFT1}+10^\circ\ \mathrm{C.})$$

(B) Image formation under condition MFT1>MFT2

The condition including the parameters when MFT1>MFT2 is as below.

$$T1>\mathrm{MFT1}>\mathrm{MFT2}$$

$$\mathrm{MFT1}>T2>\mathrm{MFT2}$$

In the fixed image obtained under the above condition, the gloss of the image part formed of the colored ink becomes higher than that of the image part formed of the transparent ink.

In order to further increase the gloss difference between these image parts, the following condition is preferably satisfied additionally.

$$T1>(\mathrm{MFT1}+10^\circ\ \mathrm{C.})$$

$$T2>(\mathrm{MFT2}+10^\circ\ \mathrm{C.})$$

<Control Unit>

A control unit that controls each device for forming an image included in the transfer type ink jet recording device is hereinafter described.

Figure 4:
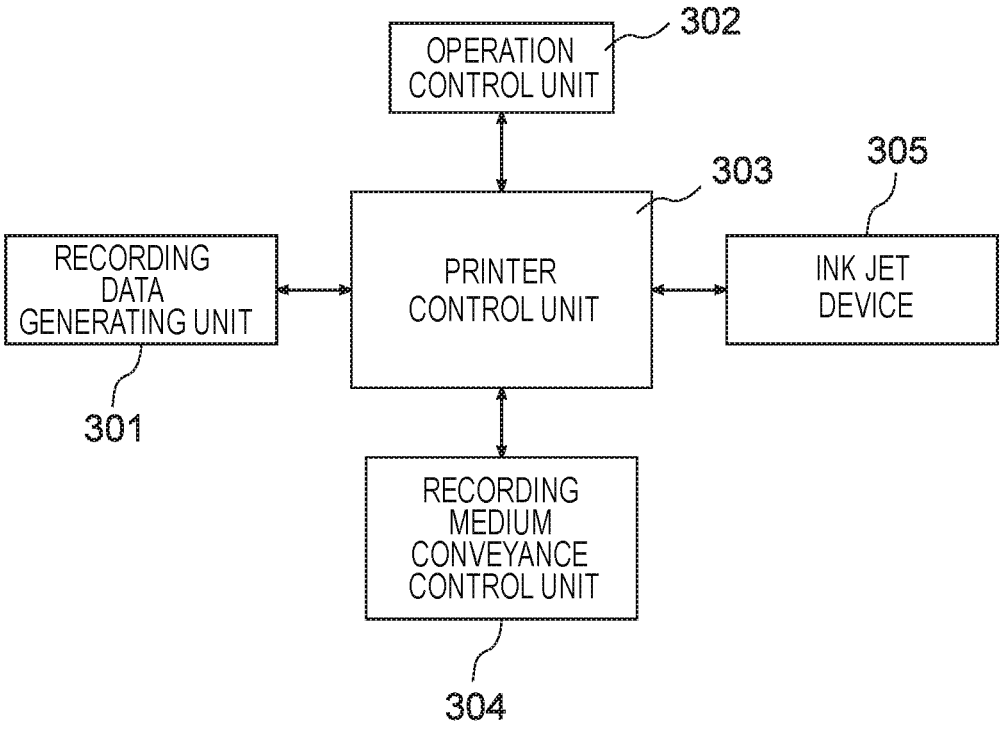
FIG. 4 is a block diagram illustrating a control system of an entire device in the transfer type ink jet recording device illustrated in FIG. 2.

FIG. 4 is a block diagram illustrating a control system of the entire device in the transfer type ink jet recording device illustrated in FIG. 2.

The control system includes a recording data generating unit 301 such as an external print server, an operation control unit 302 such as an operation panel, a printer control unit 303 that performs a recording process, a recording medium conveyance control unit 304 that conveys the recording medium, and an ink jet device 305 used in the printing.

Figure 5:
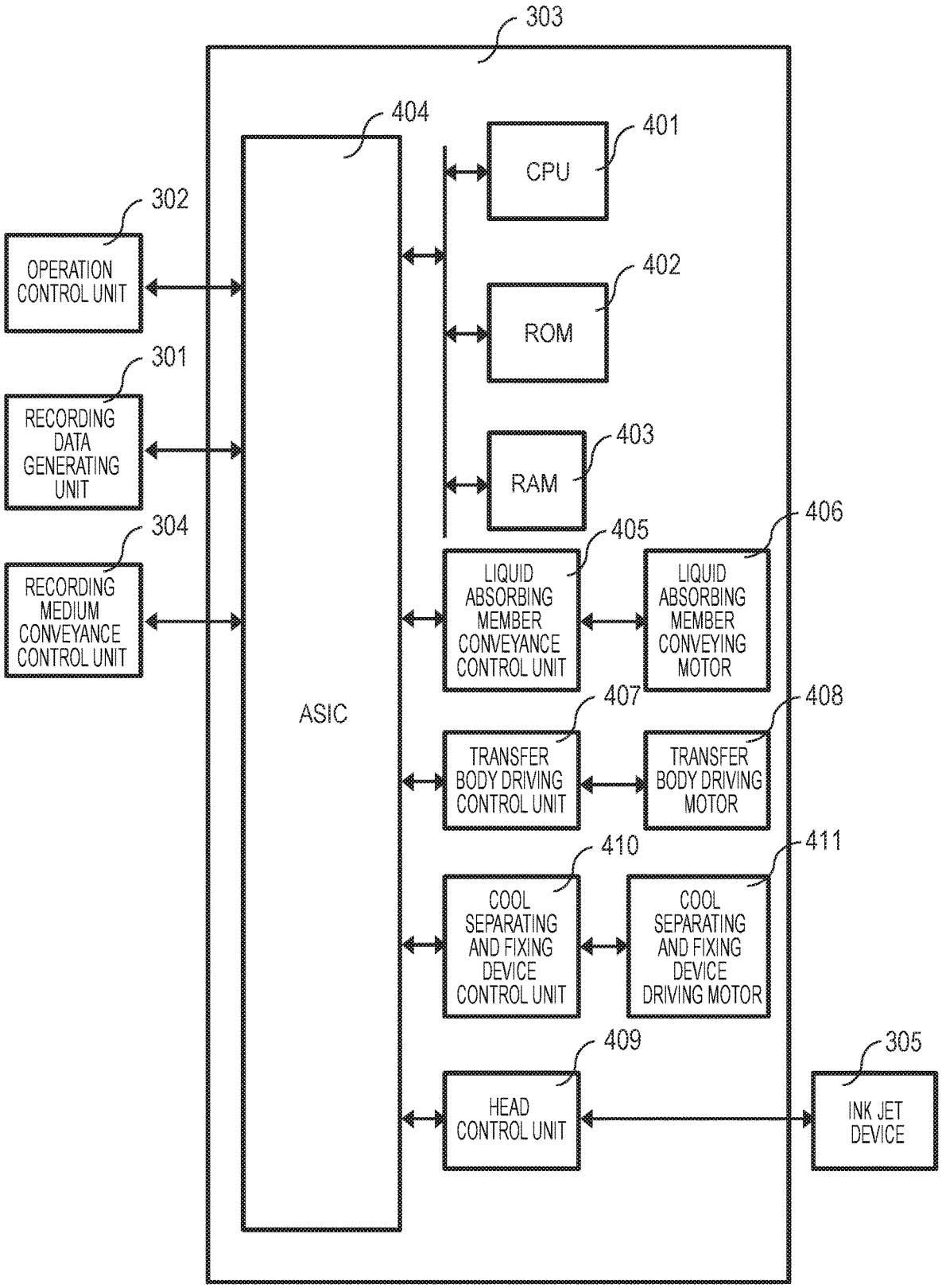
FIG. 5 is a block diagram illustrating a printer control unit illustrated in FIG. 2.

FIG. 5 is a block diagram of the printer control unit in the transfer type ink jet recording device in FIG. 2.

The printer control unit includes a CPU 401 that controls the entire printer, a ROM 402 that stores a control program for the CPU, a RAM 403 that executes the program, and an ASIC (Application Specific Integrated Circuit) 404. The ASIC incorporates a network controller, a serial IF controller, a controller for generating head data, a motor controller, and the like. The printer control unit also includes: a liquid absorbing member conveyance control unit 405 that drivers a liquid absorbing member conveying motor 406, the liquid absorbing member conveyance control unit 405 being controlled with commands through a serial IF from the ASIC 404; a transfer body driving control unit 407 that drives a transfer body driving motor 408, the transfer body driving control unit 407 being controlled with commands through a serial IF from the ASIC 404 similarly; a head control unit 409 that generates final ejecting data of the ink jet device 305, generates driving voltage, or the like; and a control unit 410 for a driving motor 411 for the cool separating and fixing device, the control unit 410 being controlled with commands through a serial IF from the ASIC 404.

(Direct Drawing Type Ink Jet Recording Device)

FIG. 3 is a schematic view illustrating one example of a schematic structure of the direct drawing type ink jet recording device.

The direct drawing type ink jet recording device has a structure similar to that of the transfer type ink jet recording device except that the direct drawing type ink jet recording device does not include the transfer body 101, the support member 102, or the transfer body cleaning device 109, and the image is formed on a recording medium 208. Therefore, this direct drawing type ink jet recording device includes a reaction liquid applying device 203, an ink applying device 204, and a liquid absorbing device 205. The reaction liquid applying device 203 includes a reaction liquid storing part 203*a* that stores the reaction liquid, and reaction liquid applying members 203*b* and 203*c* that apply the reaction liquid in the reaction liquid storing part 203*a* to the recording medium 208. The liquid absorbing device 205 includes a liquid absorbing member 205*a*, and a pressing member 205*b* for absorbing liquid. The pressing member 205*b* presses the liquid absorbing member 205*a* onto the image on the recording medium 208. The shape of the liquid absorbing member 205*a* and the pressing member 205*b* is not limited to a particular shape and the liquid absorbing member 205*a* and the pressing member 205*b* may have the shapes similar to those of the liquid absorbing member and the pressing member that can be used in the transfer type ink jet recording device. The liquid absorbing device 205 may have an extending member that extends the liquid absorbing member. In FIGS. 3, 205*c*, 205*d*, 205*e*, 205*f*, and 205*g* denote extending rollers as the extending members. A fixing member 60 has a structure similar to that of the fixing device 50 in the transfer type ink jet recording device illustrated in FIG. 2, and includes a heating roller 55, a pressing roller 56, a separating roller 59, and a fixing member 57 with an endless belt shape that is looped between the two rollers 55 and 59.

A printing part that applies ink to the recording medium 208 by the use of the ink applying device 204 and a liquid component removing part that removes the liquid component by pressing the liquid absorbing member 205*a* onto the image on the recording medium may have a recording medium support member (not illustrated) that supports the recording medium from below.

In addition, if an image including the colored ink layer and the transparent ink layer in this order from the recording medium side is formed on the recording medium, the image is formed by applying the colored ink on the recording medium and then applying the transparent ink so as to overlap at least partially with an area where the colored ink is applied.

<Recording Medium Conveying Device>

The recording medium conveying device 207 is not limited to a particular device and may be a known recording medium conveying device. One example of such a device is a recording medium conveying device including a recording medium feeding roller 207*a*, a recording medium winding roller 207*b*, and recording medium conveying rollers 207*c*, 207*d*, 207*e*, and 207*f* as illustrated in FIG. 3.

<Control Unit>

A control unit that controls each device for forming an image included in the direct drawing type ink jet recording device is hereinafter described.

A block diagram of a control system of the entire device is as illustrated in FIG. 4, and is similar to that of the transfer type ink jet recording device illustrated in FIG. 2.

Figure 6:
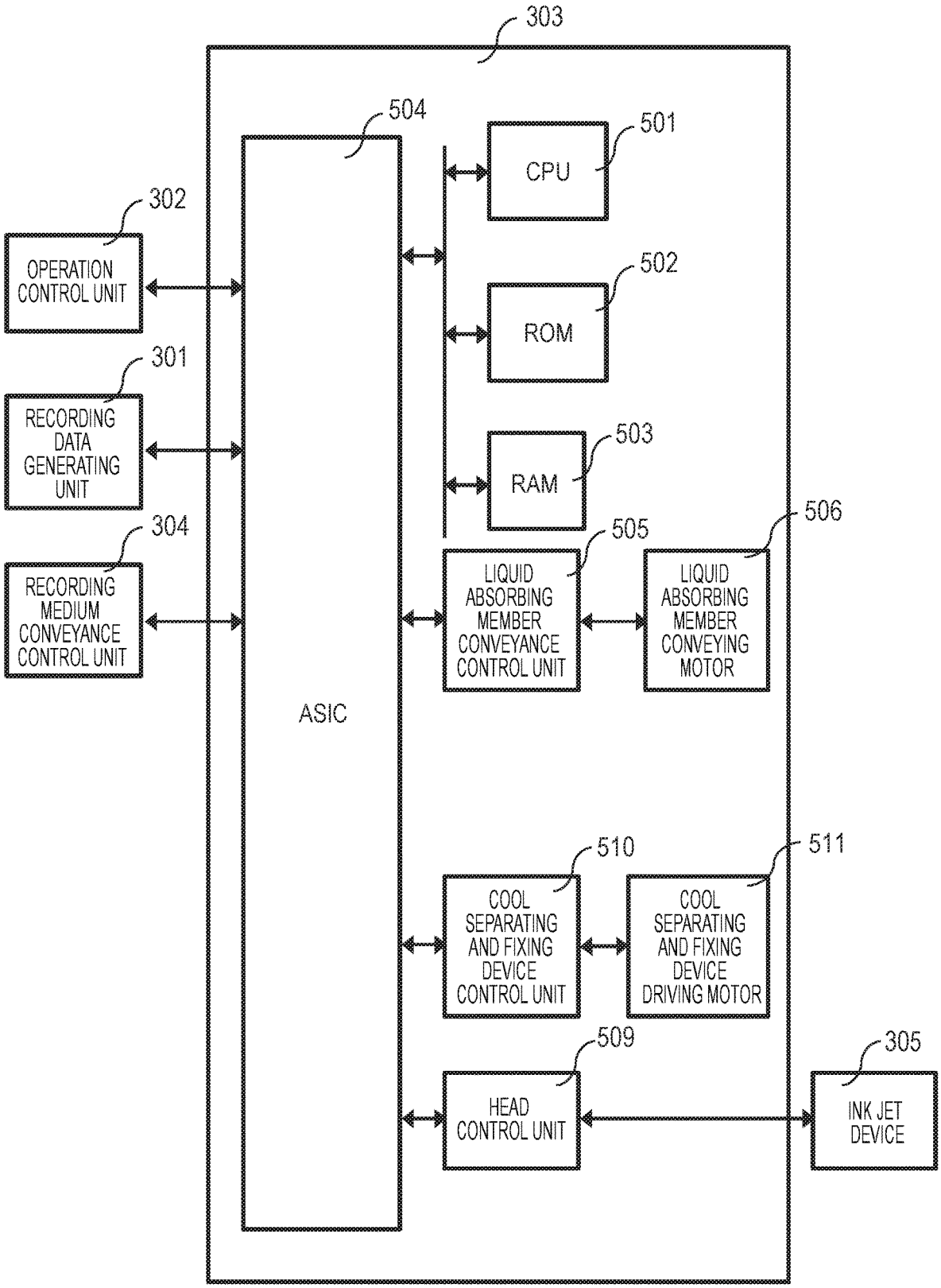
FIG. 6 is a block diagram illustrating a printer control unit in the direct drawing type ink jet recording device illustrated in FIG. 3.

FIG. 6 is a block diagram illustrating a printer control unit in the direct drawing type ink jet recording device illustrated in FIG. 3.

The printer control unit includes a CPU 501 that controls the entire printer, a ROM 502 that stores a control program for the CPU, a RAM 503 that executes the program, and an ASIC 504 that incorporates a network controller, a serial IF controller, a controller for generating head data, a motor controller, and the like. The printer control unit further includes: a liquid absorbing member conveyance control unit 505 that drives a liquid absorbing member conveying motor 506, the liquid absorbing member conveyance control unit 505 being controlled with commands through a serial IF from the ASIC 504; a head control unit 509 that generates final ejecting data of the ink jet device 305, generates driving voltage, or the like; and a control unit 510 for a driving motor 511 for the cool separating and fixing device, the control unit 510 being controlled with commands through a serial IF from the ASIC 504.

The ink jet recording method according to the present invention can form the image in which the gloss difference is large in some areas, and the unevenness in gloss is small.

EXAMPLES

The present invention is hereinafter described in more detail with reference to Examples and Comparative examples. The present invention is not limited by the examples below unless departing from the scope of the present invention. In the description of the examples below, "parts" are based on the mass unless otherwise stated.

Example 1

In Example 1, the transfer type ink jet recording device illustrated in FIG. 2 was used. The transfer body 101 is fixed to the support member 102 through an adhesive. As an elastic layer of the transfer body, a 0.5-mm-thick polyethylene terephthalate (PET) sheet coated with 0.3-mm-thick silicone rubber (KE12, Shin-Etsu Chemical Co., Ltd.) was used. Furthermore, glycidoxypropyltriethoxysilane and methyltriethoxysilane were mixed at a molar ratio of 1:1 and a mixture of a condensate obtained by thermal refluxing and an optical cation polymerization initiator (SP150, ADEKA CORPORATION) was produced. An atmospheric-pressure plasma process was performed so that the surface of the elastic layer had a water contact angle of 10 degrees or less, the mixture was applied on the elastic layer, UV rays (high-pressure mercury lamp, accumulated exposure amount 5000 mJ/cm$^2$) were delivered, and thermal curing was performed (150° C., two hours); thus, a surface layer was formed with a thickness of 0.5 μm on the elastic body and the transfer body 101 was obtained.

Although not illustrated in the present structure to simplify the description, a double-sided tape was used to keep the transfer body 101 between the transfer body 101 and the support member 102.

In the present structure, the surface of the transfer body 101 was heated at 60° C. by a heating method that is not illustrated.

The reaction liquid that was applied by the reaction liquid applying device 103 was as follows (total components: 100 parts) and the amount of applied liquid was 1 g/m$^2$.

Glutaric acid: 21.0 parts

Glycerin: 5.0 parts

Surfactant (product name: MEGAFACE F444, DIC Corporation): 5.0 parts

Ion exchanged water: the rest

The ink was prepared as below.

<Preparation of Pigment Dispersion>

A mixture of 10 parts of carbon black (product name: MONARCH 1100, Cabot Corporation), 15 parts of resin aqueous solution (obtained by neutralizing, with potassium hydroxide aqueous solution, aqueous solution of styrene-ethylacrylate-acrylic acid copolymer with an oxidation number of 150, a weight-average molecular weight (Mw) of 8000, and resin content of 20.0% by mass), and 75 parts of pure water were mixed and put in a batch vertical sand mill (AIMEX Co., Ltd.), the sand mill was filled with 200 parts of zirconia beads with a diameter of 0.3 mm, and while the mixture was cooled with water, a dispersion process was performed for five hours. This dispersion liquid was subjected to centrifugal separation to remove coarse particles and thus, a black pigment dispersion containing 10.0% by mass of pigment was obtained.

<Resin Particle>

As the resin particle, SUPERFLEX 820 (product name, minimum film forming temperature 65° C.) or SUPERFLEX 420NS (product name, minimum film forming temperature 40° C.) produced by DKS Co. Ltd., which was the liquid where anionic resin particles were dispersed, was used. SUPERFLEX 820 and SUPERFLEX 420NS are both water dispersions of urethane resin particles.

<Preparation of Ink>

The pigment dispersion and the resin particles obtained as above were mixed with the following components. Note that the amount of the ion exchange water, the rest, corresponds to the quantity by which the entire components of the ink constitute 100.0% by mass.

Pigment dispersion (coloring material is contained by 10.0% by mass): 40.0% by mass Resin particles: 20.0% by mass

[SUPERFLEX 820 (product name, minimum film forming temperature 65° C., produced by DKS Co. Ltd.) or SUPERFLEX 420NS (product name, minimum film forming temperature 40° C., produced by DKS Co. Ltd.)]

Glycerin: 7.0% by mass

Polyethylene glycol (number-average molecular weight (Mn): 1000): 3.0% by mass

Surfactant: ACETYLENOL E 100 (Kawaken Fine Chemicals Co., Ltd.): 0.5% by mass

Ion exchanged water: the rest

These materials were stirred sufficiently so as to be dispersed, and then the mixture was filtered with pressure through a microfilter (FUJIFILM Corporation) with a pore size of 3.0 μm; thus, black ink was prepared.

The transparent ink was prepared through steps similar to those for the ink by mixing the following components:

Resin particles: 20.0% by mass

[SUPERFLEX 820 (product name, minimum film forming temperature 65° C., produced by DKS Co. Ltd.) or SUPERFLEX 420NS (product name, minimum film forming temperature 40° C., produced by DKS Co. Ltd.)]

Glycerin: 5.0% by mass

Diethylene glycol: 7.0% by mass

Surfactant 1: 0.5% by mass

Ion exchanged water: the rest.

As the ink applying device 104, a liquid applying device including an ink jet head that ejects the ink on demand using an electrothermal converter was used. The liquid absorbing member 105*a* is controlled to have the speed equivalent to the moving speed of the transfer body 101 by the extending rollers 105*c*, 105*d*, and 105*e* that extend the liquid absorbing member and convey the liquid absorbing member. In order to achieve the speed equivalent to the moving speed of the transfer body 101, the recording medium 108 is conveyed by the recording medium feeding roller 107*a* and the recording medium winding roller 107*b*. In the present example, the conveying speed was 0.6 m/s and the recording medium 108 was AURORA COAT (produced by NIPPON PAPER INDUSTRIES CO., LTD., basis weight: 210 g/m$^2$).

In addition, the pressing force of the pressing member 105*b* was adjusted so that the nip pressure between the transfer body 101 and the liquid absorbing member 105*a* became 2 kg/cm$^2$ on the average. In addition, as the pressing member 105*b* in the liquid absorbing device, a pressing member with a roller shape with a roller diameter ϕ of 200 mm was used.

<Liquid Absorbing Member>

The liquid absorbing member used in the present example was formed of the following materials.

As the first layer, a multiaxially stretched film formed of a porous body made of polytetrafluoroethylene (PTFE) with an average pore diameter of 0.2 μm on a surface in contact with the intermediate image on the transfer body was used. The first layer was produced by a method of obtaining a fibrillated porous body by compressively molding emulsified polymer particles of PTFE that have been crystallized, and multiaxially stretching at a temperature of less than or equal to the melting point of PTFE.

As the second layer, a HOP series (product name, produced by HIROSE PAPER MFG CO., LTD.) including fibers with a core structure formed of polypropylene (PP) and a sheath structure formed of polyethylene (PE) was used. The second layer includes a second layer a containing fibers a and a second layer b containing fibers b. The fibers a in the second layer a have an average fiber diameter of 5 μm and the fibers b in the second layer b have an average fiber diameter of 15 μm. In the second layer, the fibers a in the second layer a disposed on the first layer side are thinner and the fibers b in the second layer b disposed on the third layer side are thicker.

As the third layer, nonwoven fabric (product name: PPS paper, HIROSE PAPER MFG CO., LTD.) made of polyphenylene sulfide (PPS) fiber (product name: TORCON, TORAY INDUSTRIES, INC.) in a wet process was used. This third layer had an average pore diameter of 20 μm. The third layer includes a first surface in contact with the intermediate image on the transfer body and a second surface opposite to the first surface. The second surface also had an average pore diameter of 20 μm.

As for the first to third layers, the first layer and the second layer were laminated first and then, the third layer was laminated thereon; thus, the liquid absorbing member including the porous body was produced.

<Transfer>

After the liquid component is absorbed from the intermediate image on the transfer body 101 by the liquid absorbing member 105*a*, the image is transferred to the recording medium 108. The pressing force of the pressing member 106 for transferring was controlled so that the nip pressure between the transfer body 101 and the pressing member 106 for transferring became 5 kgf/cm$^2$ on the average.

<Fixing>

The fixing device 50 includes the heating roller 45, the pressing roller 46, the fixing member 47 with an endless belt shape (endless fixing belt), the cooling device 48, and the separating roller 49 as illustrated in FIG. 2.

The fixing condition in the present example is as below.

As the fixing member, an endless belt having a water-repellent surface layer formed on a surface of a polyimide film (product name: Kapton, produced by Toray and E. I. DuPont, thickness 75 μm) as a film base material was used. The water-repellent surface layer was formed as below.

As a coating agent, glycidoxypropyltriethoxysilane and methyltriethoxysilane were mixed at a molar ratio of 1:1 and a mixture of a condensate obtained by thermal refluxing and an optical cation polymerization initiator (SP150, ADEKA CORPORATION) was produced. An atmospheric-pressure plasma process was performed so that the surface of the film base material had a water contact angle of 10 degrees or less, the mixture was applied on the surface of the film base material, UV rays (high-pressure mercury lamp, accumulated exposure amount 5000 mJ/cm$^2$) were delivered, and thermal curing was performed (150° C., two hours); thus, a surface layer was formed with a thickness of 0.5 μm. This fixing member had a surface roughness Ra of 0.02 μm. The pressing force of the pressing roller was controlled so that the nip pressure (pressure in heating and pressing) between the heating roller and the pressing roller became 5 kgf/cm$^2$ on the average. In addition, the temperature of the heating roller and the temperature of the separating roller were controlled as appropriate so as to become the pressing temperature T1 and the separating temperature T2 of the surface of the fixing member shown in Table 5, which is described below.

Figure 10:
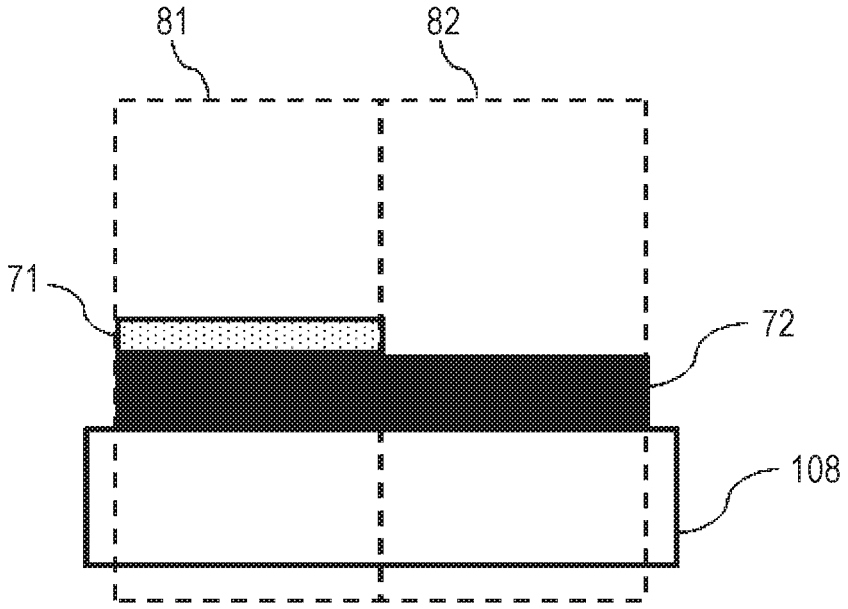
FIG. 10 is a schematic view of an output image pattern in Examples 1 to 6.

FIG. 10 is a schematic view illustrating a generation image pattern in Example 1. In FIG. 10, an image 1 is formed of black ink 72 and transparent ink 71 in an area 81, and an image 2 is formed of the black ink 72 in an area 82.

Table 1 shows the amount of each applied ink. Since the transfer type ink jet recording method is employed in the present example, the order of applying ink to the transfer body and the ink layer structure on the recording medium are inverted vertically. For example, in Table 1, in the case of the image 1 where the transparent ink and the black ink were applied in this order to the transfer body, the ink layer structure after the image is transferred on the recording medium is the black ink and the transparent ink in this order from the recording medium side. Table 2 shows the minimum film forming temperature of the black ink and the transparent ink. As shown in Table 2, the minimum film forming temperature of the black ink is 40° C. and the minimum film forming temperature of the transparent ink is 65° C. Note that as the minimum film forming temperature of the black ink and the transparent ink, the minimum film forming temperature of the resin particles included in the respective kinds of ink was employed. The minimum film forming temperature of the resin particles was measured in accordance with JIS K 6828-2 "determination of white point temperature and minimum film-forming temperature".

TABLE 1

Amount of image pattern applied in Example 1

| Amount applied to transfer body | Image 1 | Image 2 |
|---|---|---|
| Input order 1<br>Transparent ink | 10 g/m$^2$ | — |
| Input order 2<br>Black ink | 20 g/m$^2$ | 20 g/m$^2$ |

TABLE 2

Minimum film forming temperature of each ink in Example 1

| | Transparent ink | Black ink |
|---|---|---|
| Minimum film forming temperature | 65° C. | 40° C. |

First, the reaction liquid is applied on the transfer body by the reaction liquid applying device. After that, in accordance with the amount of applying the ink shown in Table 1, the ink applying device applies the transparent ink and the black ink in this order to form the image. The liquid absorbing member of the liquid absorbing device is pressed on the image formed on the transfer body so that the liquid component is removed from the image; thus, the image is formed on the transfer body successfully. Next, the recording medium conveyed by the recording medium conveying device and the transfer body having the image formed thereon are brought into contact with each other and pressed; thus, the image is transferred from the transfer body to the recording medium and the image is formed on the recording medium successfully. This recorded image is fixed using the cool separating and fixing device.

Figure 11:
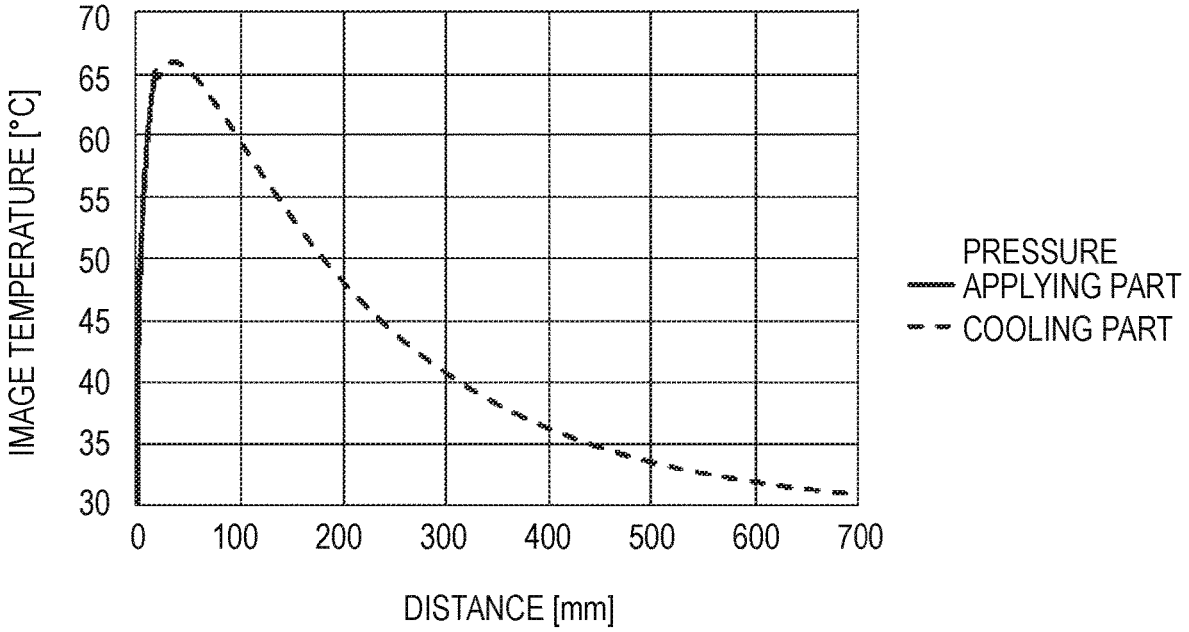
FIG. 11 is a graph illustrating a temperature profile in an image part in Examples 1 to 3.

FIG. 11 is a graph illustrating the image temperature profile from when the image is input to the pressure applying part by the heating roller and the pressing roller to when the cooling and separating are performed in the present example. The pressing temperature was set to 70° C. that was higher than the minimum film forming temperature of the transparent ink, and the separating temperature was set to 45° C. that was lower than the minimum film forming temperature of the transparent ink and higher than the minimum film forming temperature of the black ink.

Table 6 shows the results of measuring the gloss value at 20° in the obtained image 1 and image 2 in accordance with a usual method.

Additionally, the gloss difference between the image 1 and the image 2 was evaluated based on the following criteria:

A the gloss difference at 20° between the image 1 and the image 2 is 30 or more B the gloss difference at 20° between the image 1 and the image 2 is 20 or more and less than 30

C the gloss difference at 20° between the image 1 and the image 2 is 10 or more and less than 20

D the gloss difference at 20° between the image 1 and the image 2 is less than 10

The presence or absence of the uneven gloss in the image was evaluated based on the following criteria.

A The uneven gloss was not observed with eyes or an optical microscope.

B The uneven gloss was not observed with eyes but some uneven gloss was observed with an optical microscope.

C The uneven gloss was observed with eyes.

Table 6 shows the results of these evaluations.

Comparative Example 1

The image was formed and evaluated in a manner similar to Example 1 except that the pressing temperature was set to 85° C. that was 20° C. higher than the minimum film forming temperature of the transparent ink, and the separating temperature was set to 75° C. that was higher than the minimum film forming temperature of the transparent ink. Table 6 shows the measurement result and the evaluation result regarding the gloss value at 20°.

Comparative Example 2

The image was formed and evaluated in a manner similar to Comparative example 1 except that the separating temperature was set to 30° C. that was lower than the minimum film forming temperature of the black ink. Table 6 shows the measurement result and the evaluation result regarding the gloss value at 20°.

Comparative Example 3

The image was formed and evaluated in a manner similar to Example 1 except that the pressing temperature was set to 60° C. that was lower than the minimum film forming temperature of the transparent ink, and the separating temperature was set to 30° C. Table 6 shows the measurement result and the evaluation result regarding the gloss value at 20°.

Comparative Example 4

The image was formed and evaluated in a manner similar to Example 1 except that the pressing temperature was between the minimum film forming temperature of the transparent ink and the minimum film forming temperature of the black ink, and the separating temperature was higher than the minimum film forming temperature of the black ink. Table 6 shows the measurement result and the evaluation result regarding the gloss value at 20°.

As shown in Table 6, in Example 1 where the pressing temperature was higher than the minimum film forming temperature of the transparent ink and the black ink, and the separating temperature was 45° C. that was between the minimum film forming temperature of the transparent ink and the minimum film forming temperature of the black ink, the gloss difference was 17 in terms of the gloss value at 20°. In addition, in the image 1 and the image 2, the high image quality free of visible uneven gloss was obtained. In Comparative example 1, the separating temperature was 75° C. that was higher than the minimum film forming temperature of the transparent ink; therefore, the gloss value at 20° in the image 1 was 49, which was not very high. In addition, in the image 2 where the black ink with the low minimum film forming temperature was exposed, the black ink was hot offset on the fixing member side. Moreover, in Comparative example 2, the separating temperature was lower than the minimum film forming temperature of both the transparent ink and the black ink; therefore, both images are flattened and enough gloss difference was not obtained. In Comparative example 3, the gloss value at 20° was 38 in the image 1 and the gloss value at 20° was 79 in the image 2; thus, the difference in the gloss value at 20° was enough. However, in the printed sample, unnatural uneven gloss was observed in the image 1 where the transparent ink with the minimum film forming temperature higher than the pressing temperature was exposed and the image quality was not in the allowable level. It is estimated that this is because a part that was flattened and a part that was not flattened were formed at random in the image 1 in the heating and pressing. Additionally, heat was not applied enough in the heating and pressing so that the robustness of the image 1 was lower than that of the image 2. In Comparative example 4, the image 1 contains unnatural uneven gloss in the image, which is similar to Comparative example 3. In the image 2, the gloss value at 20° was 56, which was not as high as in Example 1. This is because the separating temperature is higher than the minimum film forming temperature of the black ink. In this case, even if the pressing temperature is higher than the minimum film forming temperature, the ink did not become as flat as the transparent ink in Example 1. The results from Comparative example 4 indicate that even if the pressing temperature is higher than or equal to the minimum film forming temperature of the black ink and lower than or equal to the minimum film forming temperature of the transparent ink, the large gloss difference cannot be obtained unless the separating temperature is lower than or equal to the minimum film forming temperature of the black ink.

Example 2

Example 1 is the example in which the minimum film forming temperature of the transparent ink corresponding to the outermost layer on the recording medium is high and contributes to achieving the high gloss. As described in the present example, according to the present invention, the similar effect can be obtained by making the minimum film forming temperature of the transparent ink in the outermost layer lower than that of the ink in the lower layer.

Note that the process until the recording medium having the image formed thereon is conveyed to the cool separating and fixing device is similar to that of Example 1.

Table 3 shows the minimum film forming temperature of each kind of ink in the present example. The ink with a minimum film forming temperature of 40° C. was prepared as the transparent ink that was applied onto the transfer body first, and the ink with a minimum film forming temperature of 65° C. was prepared as the black ink that was applied later. The generation image pattern was the same as the image pattern illustrated in FIG. 10 and Table 1. The cool separating and fixing condition was similar to that of Example 1 and the pressing temperature was 70° C. that was higher than the minimum film forming temperature of both ink and the separating temperature was 45° C. in the separation.

Table 6 shows the result regarding the gloss value at 20° in the present example.

TABLE 3

Minimum film forming temperature of each ink in Example 2

| | Transparent ink | Black ink |
|---|---|---|
| Minimum film forming temperature | 40° C. | 65° C. |

As shown in Table 6, the image 1 with the transparent ink in the outermost surface of the image was separated at the temperature higher than the minimum film forming temperature 40° C. of the transparent ink; therefore, the gloss value at 20° was as low as 58. On the other hand, the image 2 with the black ink in the outermost surface was separated at the temperature lower than the minimum film forming temperature of the black ink; therefore, the gloss value at 20° was 76, which was higher than that of the image 1. As a result, the difference in gloss at 20° between the images was 18. Thus, the similar gloss difference can be achieved even if the transparent ink and the colored ink have the opposite minimum film forming temperatures in the present invention.

Example 3

In the present example, the gloss of the image part with high gloss is enhanced further by performing the heating and pressing in which the pressing temperature is much higher than the minimum film forming temperature on the high-temperature side with respect to Example 1. The image pattern employed in the present example is as shown in Table 1 and FIG. 10, and the ink shown in Table 2 was used as the ink. The pressing temperature was 75° C. that was 10° C. higher than the minimum film forming temperature of the transparent ink and the separating temperature was 45° C. that was between the minimum film forming temperatures of both ink. Table 6 shows the result of the gloss value at 20° in the image parts.

As shown in Table 6, in the image 1 where the heat and pressure were applied at the temperature much higher than the minimum film forming temperature and the separation was performed at the temperature lower than the minimum film forming temperature, the gloss value at 20° was as high as 87. On the other hand, in the image 2 where the heat and pressure were applied at the temperature much higher than the minimum film forming temperature and the separation was performed at the temperature higher than the minimum film forming temperature, the gloss value at 20° was 60, which was similar to that of Example 1. As a result, the gloss difference at 20° between the images increased to 27. Thus, by applying the heat and pressure at the sufficiently high temperature that is 10° C. higher than the minimum film forming temperature of the ink existing on the outermost surface to the image part with high gloss, much higher gloss can be achieved and the contrast between the part with high gloss and the part with low gloss can be improved. In addition, the similar gloss difference was obtained also when the minimum film forming temperature of the transparent ink and the minimum film forming temperature of the black ink were exchanged and the heating and pressing and the separating were performed under the same condition.

Example 4

In the present example, the gloss of the image part with low gloss is decreased further by performing the separation in which the separating temperature is much higher than the minimum film forming temperature on the low-temperature side with respect to Example 1. The image pattern employed in the present example is as shown in Table 1 and FIG. 10, and the ink shown in Table 2 was used as the ink. The pressing temperature was 70° C. that was higher than the minimum film forming temperature of the transparent ink and the separating temperature was 50° C. that was between the minimum film forming temperatures of both ink and was 10° C. higher than the minimum film forming temperature of the black ink. Table 6 shows the result of the gloss value at 20° in the image parts.

As shown in Table 6, in the image 1 where the heat and pressure were applied at the temperature higher than the minimum film forming temperature and the separation was performed at the temperature lower than the minimum film forming temperature, the gloss value at 20° was 75, which was similar to that of Example 1. On the other hand, in the image 2 where the heat and pressure were applied at the temperature higher than the minimum film forming temperature and the separation was performed at the temperature 10° C. higher than the minimum film forming temperature, the gloss value at 20° was 50, which was lower than that of the image 2 in Example 1. As a result, the gloss difference at 20° between the images increased to 25. Thus, by performing the separation at the sufficiently high temperature that is 10° C. higher than the minimum film forming temperature of the ink existing on the outermost surface to the image part with low gloss, much lower gloss can be achieved and the contrast between the part with high gloss and the part with low gloss can be improved. In addition, the similar gloss difference was obtained also when the minimum film forming temperature of the transparent ink and the minimum film forming temperature of the black ink were exchanged and the heating and pressing and the separating were performed under the same condition.

Example 5

In the present example, the gloss of the image part with high gloss is enhanced further and the gloss of the image part with low gloss is decreased further by performing the separation in which the pressing temperature is much higher than the minimum film forming temperature on the high-temperature side and the separating temperature is much higher than the minimum film forming temperature on the low-temperature side. The image pattern employed in the present example is as shown in Table 1 and FIG. 10, and the ink shown in Table 2 was used as the ink. The pressing temperature was 75° C. that was 10° C. higher than the minimum film forming temperature of the transparent ink and the separating temperature was 50° C. that was between the minimum film forming temperatures of both ink and that was 10° C. higher than the minimum film forming temperature of the black ink. Table 6 shows the result of the gloss value at 20° in the image parts.

As shown in Table 6, in the image 1 where the heat and pressure were applied at the temperature much higher than the minimum film forming temperature and the separation was performed at the temperature lower than the minimum film forming temperature, the gloss value at 20° was as high as 85. On the other hand, in the image 2 where the heat and pressure were applied at the temperature higher than the minimum film forming temperature and the separation was performed at the temperature 10° C. higher than the minimum film forming temperature, the gloss value at 20° was 52, which was lower than that of the image 2 in Example 1. As a result, the gloss difference at 20° between the images drastically increased to 33. Thus, by setting the pressing temperature sufficiently high, that is, 10° C. higher than the minimum film forming temperature on the high-temperature side, the gloss of the part with high gloss can be increased further and by setting the separating temperature sufficiently high, that is, 10° C. higher than the minimum film forming temperature on the low-temperature side, the gloss of the part with low gloss can be decreased further. As a result, the contrast between the part with high gloss and the part with low gloss can be improved. In addition, the similar gloss difference was obtained also when the minimum film forming temperature of the transparent ink and the minimum film forming temperature of the black ink were exchanged and the heating and pressing and the separating were performed under the same condition.

Example 6

In the present example, wax particles are contained in the transparent ink. Since the wax particles added to the transparent ink change sharply in hardness near the melting point, the effect of making the separating temperature close to the pressing temperature can be expected.

The wax particle used in the present embodiment has a melting point of 65° C. and the quantity ratio (based on mass) of the resin particles contained in the transparent ink and the wax to be added in Example 1 was 2:1.

Table 4 shows the minimum film forming temperature of the transparent ink and the black ink in the present example. As shown in Table 4, the transparent ink containing the wax particles had a minimum film forming temperature of 65° C. The same black ink as that of Example 1 was used.

In the present example, the pressing temperature was set to 70° C. that was 5° C. higher than the minimum film forming temperature on the high-temperature side in a manner similar to Examples 1, 2, and 4. In addition, the separating temperature was set to 60° C. that was much higher than the minimum film forming temperature on the low-temperature side. The results are shown in Table 6.

As shown in Table 6, the pressing temperature was just 5° C. higher than the minimum film forming temperature of the transparent ink and enough temperature difference was not achieved like in Example 3; however, the gloss value at 20° in the image 1 in Example 6 where the wax particles were contained in the transparent ink was as high as 83. It is supposed that this is because the wax particles in the transparent ink became suddenly soft near the minimum film forming temperature and the wax particles adhere to the fixing member although the temperature difference is as small as +5° C. of the minimum film forming temperature of the transparent ink. On the other hand, the separating temperature was much higher than the minimum film forming temperature of the black ink in a manner similar to Example 4; therefore, the gloss value at 20° was as low as 49. Therefore, by using the sharp temperature characteristic unique to the wax particles and containing the wax particles in the ink, the large gloss difference, which was observed in Example 3 or 5, can be obtained although the large temperature difference from the minimum film forming temperature was not provided. In addition, even if the colored ink image part has the high gloss as described in Example 2, adding the wax particles in the colored ink and decreasing the pressing temperature provide the similar effect.

TABLE 4

Minimum film forming temperature of each ink in Example 6

| | Transparent ink | Black ink |
|---|---|---|
| Minimum film forming temperature | 65° C. | 40° C. |

One of the advantageous effects of the present example is that the cooling distance can be drastically shortened by reducing the temperature difference between the pressing temperature and the separating temperature.

Table 5 shows the pressing temperature, the separating temperature, and the cooling distance in each example. As shown in Table 5, in Example 6 where the wax particles are contained in the transparent ink and the temperature difference between the pressing temperature and the separating temperature was reduced, the cooling distance is shorter than that in the other examples. Thus, even if the device is reduced in size or has the same size, the power consumption for the cooling capability can be reduced and the linear velocity can be enhanced further.

TABLE 5

Cooling distance in each example

| | Pressing temperature | Separating temperature | Cooling distance |
|---|---|---|---|
| Example 1 | 70° C. | 45° C. | 220 mm |
| Example 2 | 70° C. | 45° C. | 220 mm |
| Example 3 | 75° C. | 45° C. | 258 mm |
| Example 4 | 70° C. | 50° C. | 163 mm |
| Example 5 | 75° C. | 50° C. | 202 mm |
| Example 6 | 70° C. | 60° C. | 119 mm |

TABLE 6

Results of examination in Examples and Comparative examples

| | Minimum film forming temperature (transparent ink) | Minimum film forming temperature (black ink) | Pressing temperature | Separating temperature | Gloss value at 20° Image 1 | Gloss value at 20° Image 2 | Evaluation of gloss difference | Evaluation of uneven gloss |
|---|---|---|---|---|---|---|---|---|
| Example 1 | 65° C. | 40° C. | 70° C. | 45° C. | 78 | 61 | C | B |
| Example 2 | 40° C. | 65° C. | 70° C. | 45° C. | 58 | 76 | C | B |
| Example 3 | 65° C. | 40° C. | 75° C. | 45° C. | 87 | 60 | B | A |
| Example 4 | 65° C. | 40° C. | 70° C. | 50° C. | 75 | 50 | B | A |
| Example 5 | 65° C. | 40° C. | 75° C. | 50° C. | 85 | 52 | A | A |
| Example 6 | 65° C. | 40° C. | 70° C. | 60° C. | 83 | 49 | A | A |

TABLE 6-continued

Results of examination in Examples and Comparative examples

| | Minimum film forming temperature (transparent ink) | Minimum film forming temperature (black ink) | Pressing temperature | Separating temperature | Gloss value at 20° Image 1 | Gloss value at 20° Image 2 | Evaluation of gloss difference | Evaluation of uneven gloss |
|---|---|---|---|---|---|---|---|---|
| Comparative example 1 | 65° C. | 40° C. | 85° C. | 75° C. | 49 | — | D | B |
| Comparative example 2 | 65° C. | 40° C. | 85° C. | 30° C. | 83 | 81 | D | A |
| Comparative example 3 | 65° C. | 40° C. | 60° C. | 30° C. | (38) | 79 | A | C |
| Comparative example 4 | 65° C. | 40° C. | 60° C. | 45° C. | (35) | 56 | B | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-191929, filed Oct. 10, 2018, which is hereby incorporated by reference herein in its entirety.

What is claimed is:

1. An ink jet recording method comprising:

forming an image on a recording medium using a colored ink containing a coloring material and a first resin, and a transparent ink containing a second resin; and fixing the image on the recording medium, the fixing comprising:

heating and pressing the image with a fixing member in contact with the image formed on the recording medium;

cooling the image that has been heated and pressed; and separating the image that has been cooled from the fixing member, thereby fixing the image on the recording medium, wherein a temperature (T1) of a surface of the fixing member when the image is heated and pressed is higher than a minimum film forming temperature (MFT1) of the colored ink and a minimum film forming temperature (MFT2) of the transparent ink, and wherein a temperature (T2) of the surface of the fixing member when the image is separated from the fixing member is between the minimum film forming temperature (MFT1) of the colored ink and the minimum film forming temperature (MFT2) of the transparent ink.

2. The ink jet recording method according to claim 1, wherein the MFT1 is lower than the MFT2.

3. The ink jet recording method according to claim 2, wherein the T1 is 10° C. or more higher than the MFT2.

4. The ink jet recording method according to claim 2, wherein the T2 is 10° C. or more higher than the MFT1.

5. The ink jet recording method according to claim 2, wherein the image includes on the recording medium, a colored ink layer formed of the colored ink and a transparent ink layer formed of the transparent ink in this order from a side of the recording medium.

6. The ink jet recording method according to claim 1, wherein the MFT1 is higher than the MFT2.

7. The ink jet recording method according to claim 6, wherein the T1 is 10° C. or more higher than the MFT1.

8. The ink jet recording method according to claim 6, wherein the T2 is 10° C. or more higher than the MFT2.

9. The ink jet recording method according to claim 1, wherein the first resin is a resin particle.

10. The ink jet recording method according to claim 1, wherein the second resin is a resin particle.

11. The ink jet recording method according to claim 1, wherein at least one of the colored ink and the transparent ink has a wax particle.

12. The ink jet recording method according to claim 1, wherein the fixing member has a surface roughness Ra of 0.1 μm or less.

13. The ink jet recording method according to claim 1, wherein the forming of the image comprises:

applying the colored ink and the transparent ink on a transfer body so as to form an intermediate image; and transferring the intermediate image from the transfer body to the recording medium so as to form the image on the recording medium.

14. The ink jet recording method according to claim 13, further comprising applying a reaction liquid to increase viscosity of the colored ink and/or the transparent ink so as to at least partially overlap with at least one of an area where the colored ink is applied and an area where the transparent ink is applied on the transfer body.

15. The ink jet recording method according to claim 13, further comprising removing, by using a liquid absorbing member, at least a part of a liquid component from the intermediate image formed on the transfer body.

16. The ink jet recording method according to claim 1, wherein the forming of the image is forming of the image by applying the colored ink and the transparent ink on the recording medium.

17. The ink jet recording method according to claim 16, further comprising applying a reaction liquid to increase viscosity of the colored ink and/or the transparent ink so as to at least partially overlap with at least one of an area where the colored ink is applied and an area where the transparent ink is applied on the recording medium.

18. The ink jet recording method according to claim 16, further comprising removing, by using a liquid absorbing member, at least a part of a liquid component from the image formed on the recording medium.

* * * * *